US009530306B2

(12) United States Patent
Morimoto et al.

(10) Patent No.: US 9,530,306 B2
(45) Date of Patent: Dec. 27, 2016

(54) INFORMATION NOTIFICATION METHOD, INFORMATION TERMINAL, AND PROGRAM

(71) Applicant: Panasonic Intellectual Property Corporation of America, Torrance, CA (US)

(72) Inventors: Takashi Morimoto, Osaka (JP); Toshihisa Nakano, Osaka (JP); Takahiro Yamaguchi, Osaka (JP); Hiroshi Amano, Osaka (JP); Masayuki Kozuka, Osaka (JP); Motoji Ohmori, Osaka (JP); Takako Hirose, Kyoto (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 226 days.

(21) Appl. No.: 14/415,335

(22) PCT Filed: Jun. 18, 2014

(86) PCT No.: PCT/JP2014/003278

§ 371 (c)(1),
(2) Date: Jan. 16, 2015

(87) PCT Pub. No.: WO2014/208057

PCT Pub. Date: Dec. 31, 2014

(65) Prior Publication Data

US 2015/0179057 A1 Jun. 25, 2015

Related U.S. Application Data

(60) Provisional application No. 61/838,540, filed on Jun. 24, 2013.

(51) Int. Cl.
*G08C 17/02* (2006.01)
*G08C 17/00* (2006.01)

(52) U.S. Cl.
CPC ..... *G08C 17/02* (2013.01); *G08C 17/00* (2013.01); *G08C 2201/32* (2013.01)

(58) Field of Classification Search
CPC ..... G08C 17/00; G08C 17/02; G08C 2201/32
See application file for complete search history.

(56) References Cited

U.S. PATENT DOCUMENTS

2014/0167929 A1* 6/2014 Shim ..... G08C 17/02 340/12.5
2015/0178630 A1* 6/2015 Miyazaki ..... G06N 5/047 706/48

FOREIGN PATENT DOCUMENTS

EP 2 752 968 7/2014
JP 2010-49455 3/2010
(Continued)

OTHER PUBLICATIONS

International Search Report issued Sep. 2, 2014 in International (PCT) Application No. PCT/JP2014/003278.
(Continued)

*Primary Examiner* — Nabil Syed
(74) *Attorney, Agent, or Firm* — Wenderoth, Lind & Ponack, L.L.P.

(57) ABSTRACT

A usual setting state in accordance with a current in-house state and a device state is selected using an acquired in-house state and a device state from a plurality of setting states classified in advance in accordance with in-house states and device states. When the selected usual setting state and the acquired setting state differ from each other, a first notification that notifies a user of the difference is performed and a state of an information terminal is transitioned to a state where an input for remotely controlling a second device can be accepted.

11 Claims, 35 Drawing Sheets

(56) References Cited

FOREIGN PATENT DOCUMENTS

| | | |
|---|---|---|
| JP | 2010-268638 | 11/2010 |
| WO | 2013/031886 | 3/2013 |

OTHER PUBLICATIONS

Norihito Ishikawa et al., "Technology Reports Seikatsu Ketai no Saranaru Tayoka o Gugenka suru Gijutsu Tokusyu", NTT DoCoMo Technical Journal, Apr. 1, 2008, vol. 16, No. 1, pp. 26-35 along with English translation.

* cited by examiner

FIG. 6A

| USER ID | DATE AND TIME OF GOING OUT | ELECTRIC THERMOS POT | IHC | WASHING MACHINE |
|---|---|---|---|---|
| 978 | : | : | : | : |
| | 4/9 7:03 | HOT WATER LOCK | OFF | OFF |
| | 4/10 7:02 | HOT WATER LOCK | ON → OFF | OFF |
| | 4/11 7:07 | HOT WATER LOCK | OFF | OFF |
| | 4/12 7:03 | HOT WATER LOCK | OFF | OFF |

PAST DATA

CURRENT DATA

FIG. 6B

| USER ID | DATE AND TIME OF GOING OUT | ELECTRIC THERMOS POT | IHC | WASHING MACHINE | |
|---|---|---|---|---|---|
| 978 | : | : | : | : | PAST DATA |
| | 4/9 19:01 | HOT WATER LOCK | POWER SHUTDOWN | CHILD LOCK | |
| | 4/10 19:02 | HOT WATER LOCK | POWER SHUTDOWN | CHILD LOCK | |
| | 4/11 19:00 | HOT WATER LOCK | POWER SHUTDOWN | CHILD LOCK | |
| | 4/12 19:01 | HOT WATER LOCK | ON → POWER SHUTDOWN | CHILD LOCK | CURRENT DATA |

FIG. 7A

| USER ID | DATE AND TIME OF GOING OUT | IN-HOUSE STATE (NUMBER OF PEOPLE AT HOME) | DEVICE STATE (VIEWED TELEVISION PROGRAM) | ... |
|---|---|---|---|---|
| 978 | : | : | : | ... |
| | 4/9 7:03 | 3 | JAPANESE PERIOD DRAMA | ... |
| | 4/10 7:02 | 3 | JAPANESE PERIOD DRAMA | ... |
| | 4/11 7:07 | 3 | JAPANESE PERIOD DRAMA | ... |
| | 4/12 7:03 | 3 | JAPANESE PERIOD DRAMA | ... |

PAST DATA

CURRENT DATA

FIG. 7B

| USER ID | DATE AND TIME OF GOING OUT | IN-HOUSE STATE (NUMBER OF PEOPLE AT HOME) | DEVICE STATE (VIEWED TELEVISION PROGRAM) | ···· | |
|---|---|---|---|---|---|
| 978 | : | : | : | : | PAST DATA |
| | 4/9 19:01 | 2 | CHILD'S PROGRAM | ··· | |
| | 4/10 19:02 | 2 | CHILD'S PROGRAM | ··· | |
| | 4/11 19:00 | 2 | CHILD'S PROGRAM | ··· | |
| | 4/12 19:01 | 2 | CHILD'S PROGRAM | ··· | CURRENT DATA |

FIG. 9

| | | | IN-HOUSE STATE | DEVICE STATE | SETTING STATE | | |
|---|---|---|---|---|---|---|---|
| USER ID | TIME SLOT | DAY OF WEEK | NUMBER OF PEOPLE AT HOME | VIEWED TELEVISION PROGRAM | ELECTRIC THERMOS POT | IHC | WASHING MACHINE |
| 978 | | : | : | : | | | : |
| | 6:00-12:00 | MONDAY | 3 | JAPANESE PERIOD DRAMA | HOT WATER LOCK | OFF | OFF |
| | 7:00-21:00 | TUESDAY | 2 | CHILD PROGRAM | HOT WATER LOCK | POWER SHUTDOWN | CHILD LOCK |
| | 18:00-21:00 | WEDNESDAY | 5 | VARIETY | OFF | OFF | OFF |
| | 21:00-22:00 | THURSDAY | 5 | VARIETY | OFF | OFF | OFF |
| | ... | ... | ... | ... | ... | ... | ... |
| | DEFAULT | | — | — | POWER SHUTDOWN | POWER SHUTDOWN | CHILD LOCK |

FIG. 12

| CLUSTER | IN-HOUSE STATE | SETTING STATE |
|---|---|---|
| CLUSTER A | 10 YEAR OLD CHILD PRESENT, GOING OUT AROUND 12:00 TO 15:00, VIEWED CHILD PROGRAM | MICROWAVE OVEN: CHILD LOCK<br>TELEVISION SET: NO OPERATION<br>AIR CONDITIONER: NO OPERATION |
| CLUSTER B | 10 YEAR OLD CHILD PRESENT, GOING OUT AROUND 12:00 TO 13:00, VIEWED PROGRAM: VARIETY | MICROWAVE OVEN: CHILD LOCK<br>TELEVISION SET: OFF<br>AIR CONDITIONER: OFF |
| CLUSTER C | 10 YEAR OLD CHILD ABSENT, GOING OUT AROUND 10:00 TO 11:00, VIEWED JAPANESE PERIOD DRAMA | MICROWAVE OVEN: CHILD LOCK<br>TELEVISION SET: OFF<br>AIR CONDITIONER: OFF |

FIG. 14

| CLUSTER | CONDITION 1 (NUMBER OF PIECES OF DATA) | CONDITION 2 (NUMBER OF DEVICE OPERATIONS) | CONDITION 3 (MOVEMENT OF CENTER VALUE) |
|---|---|---|---|
| CLUSTER A | ○ (NUMBER OF PIECES OF INPUT DATA: 8 > THRESHOLD: 5) | ○ CERTAIN VALUE (MAJORITY) OR MORE IN CLUSTER USES: MICROWAVE OVEN: CHILD LOCK TELEVISION SET: OFF AIR CONDITIONER: OFF | ○ (MOVEMENT OF CENTER VALUE < CONSTANT k) |
| CLUSTER B | × (NUMBER OF PIECES OF INPUT DATA: 2 < THRESHOLD: 5) | × USE NO UNIFORMITY FOR USE OF ELECTRICAL HOME APPLIANCE IN CLUSTER | × (MOVEMENT OF CENTER VALUE > CONSTANT k) |
| CLUSTER C | × (NUMBER OF PIECES OF INPUT DATA: 3 < THRESHOLD: 5) | ○ CERTAIN VALUE (MAJORITY) OR MORE IN CLUSTER USES: MICROWAVE OVEN: OFF TELEVISION SET: OFF AIR CONDITIONER: OFF | ○ (MOVEMENT OF CENTER VALUE < CONSTANT k) |

INFORMATION NOTIFICATION METHOD, INFORMATION TERMINAL, AND PROGRAM

TECHNICAL FIELD

The present disclosure relates to a technique for notifying a user of information in a remote control system that remotely controls a device installed inside a house of the user in use of an information terminal.

BACKGROUND ART

Conventionally, there is a system for confirming and operating a state of a plurality of electrical home appliances in a house using a network from outside of the house. The system detects that a resident has gone out and turns off power of each electrical home appliance, with the detection of the resident who goes out acting as a trigger. For example, Patent Literature 1 discloses a technique for collectively controlling devices in a home, with a connection between a household charger and an electric vehicle or a coming home or going out of a user acting as a trigger.

CITATION LIST

Patent Literature

Patent Literature 1: Japanese Unexamined Patent Publication No. 2010-268638

SUMMARY OF INVENTION

However, Patent Literature 1 described above requires further improvement.

An information notification method according to an aspect of the present disclosure is an information notification method in a remote control system that remotely controls a device installed inside a house of a user in use of an information terminal, the method including:

sensing a movement of the user from inside of the house to outside of the house or a movement of the user from outside of the house to inside of the house;

acquiring, when the movement is sensed, an in-house state indicating a state inside the house, a device state indicating a state of a prescribed first device installed inside the house, and a setting state of a second device which is installed inside the house and which is a remote control object;

selecting a usual setting state corresponding to the acquired in-house state and device state in use of the acquired in-house state and device state from a plurality of setting states classified in advance according to the in-house state and the device state, performing, when the selected usual setting state and the acquired setting state differ from each other, a first notification which notifies the user of the difference; and performing a transition of a state of the information terminal to a state where an input for remotely controlling the second device can be accepted.

BRIEF DESCRIPTION OF DRAWINGS

FIG. 6A is a diagram showing a setting state history which records a date and time when a user went out and a setting state of a device inside the house upon going out.

FIG. 6B is a diagram showing a setting state history which records a date and time when a user went out and a setting state of a device inside the house upon going out.

FIG. 7A is a diagram showing an in-house history which records a date and time when a user went out, an in-house state, and a device state in the house of the same user as in FIGS. 6A and 6B.

FIG. 7B is a diagram showing an in-house history which records a date and time when a user went out, an in-house state, and a device state in the house of the same user as in FIGS. 6A and 6B.

FIG. 9 is a diagram showing an example of a setting file.

FIG. 12 is a diagram showing characteristics of each cluster shown in FIG. 11.

FIG. 14 is a diagram showing an example of a cluster condition.

Figure 1A:
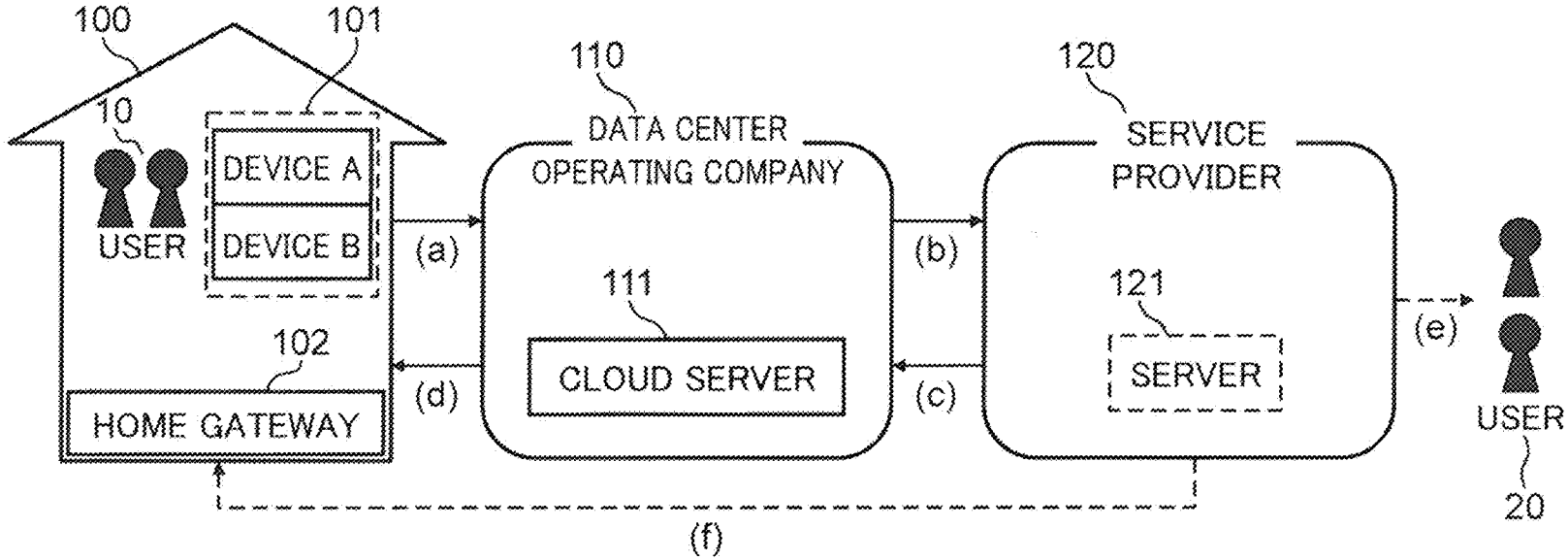
FIG. 1A is a diagram showing an example of an overview of a system configuration when providing a service for remotely controlling a device installed inside a house to a user.

DESCRIPTION OF EMBODIMENTS (Findings on which the Present Invention is Based)

Techniques for acquiring information from a plurality of devices inside a house and remotely controlling the devices from outside of the house are under consideration. As described in Patent Literature 1, a major method in conventional remote control involves executing specific control such as collectively turning off a plurality of devices or controlling devices according to a control pattern defined in a setting file upon a user going out or upon the user coming home. When a method of controlling devices with a setting file is adopted, the user must manually edit the setting file when a new device is added. Therefore, performing fine control requires a certain amount of effort by the user.

In addition, with remote control of devices inside the house, since daily use is expected, it is important to use an interface that does not burden the user. For example, when a notification of an operation state of a device is performed so as to compel a user to input a response each time the user comes home or goes out, the user will feel hassled. As a result, the user experiences stress. On the other hand, when automatically controlling a device without issuing a notice of an operation state of the device upon the user coming home or upon the user going out, the user cannot be made aware of whether or not the device is really turned off and may cause the user to experience anxiety.

The present disclosure provides a technique capable of providing reassurance to a user by giving a notice of an operation state of a device upon the user going out or upon the user coming home. In addition, the present disclosure provides a technique for providing a technique capable of reducing an operation burden on a user by presenting a notification that compels the user to perform input only when necessary.

An information notification method according to an aspect of the present disclosure is an information notification method in a remote control system that remotely controls a device installed inside a house of a user in use of an information terminal, the method including:

sensing a movement of the user from inside of the house to outside of the house or a movement of the user from outside of the house to inside of the house;

acquiring, when the movement is sensed, an in-house state indicating a state inside the house, a device state indicating a state of a prescribed first device installed inside the house, and a setting state of a second device which is installed inside the house and which is a remote control object;

selecting a usual setting state corresponding to the acquired in-house state and device state in use of the acquired in-house state and device state from a plurality of setting states classified in advance according to the in-house state and the device state, performing, when the selected usual setting state and the acquired setting state differ from each other, a first notification which notifies the user of the difference; and performing a transition of a state of the information terminal to a state where an input for remotely controlling the second device can be accepted.

In this case, when a current setting state of a device that is a remote control object differs from a usual setting state, a first notification is executed which notifies the user of the difference. Accordingly, for example, when the user forgets to turn off power of the device upon going out, the fact that the user forgot to turn off the device is notified to the user. In addition, when the user desires to turn off the power of the device, the user can input an operation for turning off the power of the device to an information terminal and restore the device to a usual setting state. Accordingly, the user can go out without feeling anxiety and can be provided with reassurance.

In addition, in the aspect described above, when the selected usual setting state and the acquired setting state match each other, a second notification which notifies the user of the match may be performed.

In this case, when the setting state of the device is the same as a usual setting state, a simplified second notification that does not compel the user to input a response is performed. Therefore, reassurance can be provided to the user as compared to a case of adopting a mode where nothing is notified to the user. In addition, since the user need not input confirmation with respect to a notification, an operation burden on the user can be reduced.

Furthermore, in the aspect described above, the in-house state may include the number of people at home.

In this case, since a usual setting state of a device corresponding to the number of people at home is selected from a plurality of setting states classified in advance, a setting state that accurately reflects the usual setting state can be selected.

In addition, in the aspect described above, the remote control system may include a database that stores in association with one another the in-house state, the device state, and the setting state collected from inside one or more houses, and the classified setting state may be a first setting state that is obtained by classifying the setting states collected from inside a first house in which one user who is to receive a service resides according to the in-house state and the device state or a second setting state obtained by classifying the setting state collected from inside the first house and from inside one or more second houses that differ from the first house according to the in-house state and the device state.

The first setting state is a setting state obtained by classifying setting states collected from inside a first house in which one user resides according to the in-house state and the device state. Therefore, when the first setting state is adopted, a setting state can be selected which better reflects a situation inside the house of a corresponding user. On the other hand, the second setting state is a setting state obtained by classifying setting states inside a plurality of houses according to the in-house state and the device state. Therefore, for example, when the number of setting states collected from inside the first house is insufficient, a setting state reflecting a situation inside an ordinary house can be selected. As a result, even in a case of a user to which a service according to the present remote control system is applied for the first time, a setting state reflecting a situation inside the house of the user to a certain degree can be selected.

Furthermore, in the aspect described above, the usual setting state may be first selected from among the first setting states, and when the usual setting state cannot be selected from among the first setting states, the usual setting state may be selected from among the second setting states.

In this case, first, a setting state corresponding to a current in-house state and device state is selected from among the first setting states, and if a setting state cannot be selected, a setting state corresponding to a current in-house state and device state is selected from among the second setting states. Therefore, a setting state corresponding to the situation inside the house of the user can be selected using the first setting states as much as possible. On the other hand, when a selection cannot be made, since a setting state corresponding to the situation inside the house of the user is selected from among second setting states based on general households, a setting state reflecting a situation inside the house of the user to a certain degree can be selected as compared to a case where a default value defined in advance is selected.

In addition, in the aspect described above, the first notification and the second notification may be performed using at least one of an image and sound. In this case, a user can visually or acoustically recognize the first notification and the second notification.

Furthermore, in the aspect described above, the second notification may be performed using an image, and once a certain period of time lapses after displaying the image, the image may be erased to finish the second notification.

In this case, since the second notification is automatically erased once a certain period of time lapses, a user need not input an operation for erasing the image representing the second notification after confirming the second notification. Therefore, an operation burden on the user can be reduced.

In addition, in the aspect described above, the remote control system may include a database that stores in association with one another the in-house state, the device state, and the setting state collected from inside the house, wherein the in-house state and the device state stored in the database may be clustered and the most numerous setting state among setting states corresponding to a cluster to which the acquired in-house state and device state belong may be selected as the usual setting state.

In this case, by subjecting in-house states and device states to a cluster process, a cluster to which the current in-house state and device state belong can be identified and a setting state corresponding to the identified cluster is selected as a usual setting state. Therefore, a usual setting state in accordance with a current situation inside a house can be accurately identified.

Furthermore, in the aspect described above, from among a first condition under which the number of pieces of clustered data in an object cluster to which the acquired in-house state and device state belong is greater than a first threshold, a second condition under which a proportion of the most numerous setting state among setting states corresponding to the object cluster is greater than a second threshold, and a third condition under which an amount of movement of a center value of the object cluster when the acquired in-house state and device state are added is equal to or less than a third threshold, when at least one condition is satisfied, the most numerous setting state corresponding to the object cluster may be selected as the usual setting state.

When the first condition is used, the object cluster is judged to be valid if the number of pieces of clustered data in the object cluster is greater than a first threshold. In addition, when the second condition is used, the object cluster is judged to be valid if the proportion of a most numerous setting state among setting states corresponding to the object cluster is greater than a second threshold. Furthermore, when the third condition is used, the object cluster is judged to be valid if an amount of movement of a center value of the object cluster when the acquired in-house state and the device state are added is equal to or less than a third threshold. Therefore, a usual setting state is prevented from being selected based on a cluster with low reliability.

Moreover, all of the embodiments described below represent specific examples of the present invention. Numerical values, shapes, components, steps, and orders of steps described in the following embodiments represent examples and are not intended to limit the present invention. In addition, components not described in independent claims representing highest concepts among the components of the following embodiments are to be described as arbitrary components. Furthermore, respective contents of all embodiments can be combined with one another.

(Overview of Service to be Provided)

FIG. 1A is a diagram showing an overview of a system configuration when providing a service for remotely controlling a device installed inside a house to a user.

A group 100 is, for example, a corporation, an organization, and a household and may be of any size. The group 100 includes a device A and a device B which constitute a plurality of devices 101 and a home gateway 102. The plurality of devices 101 include devices capable of connecting to the Internet (for example, a smartphone, a PC, and a TV) as well as devices incapable of connecting to the Internet by themselves (for example, a lighting fixture, a washing machine, and a refrigerator). The group 100 may include devices that become capable of connecting to the Internet via the home gateway 102 even though the devices are incapable of connecting to the Internet by themselves. In addition, the group 100 includes a user 10 who uses the plurality of devices 101.

Figure 1B:
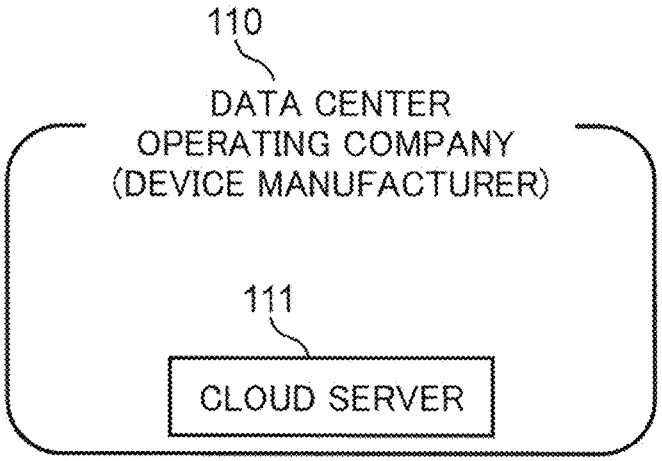
FIG. 1B is a diagram showing another example of an overview of a system configuration when providing a service for remotely controlling a device installed inside a house to a user.
Figure 1C:
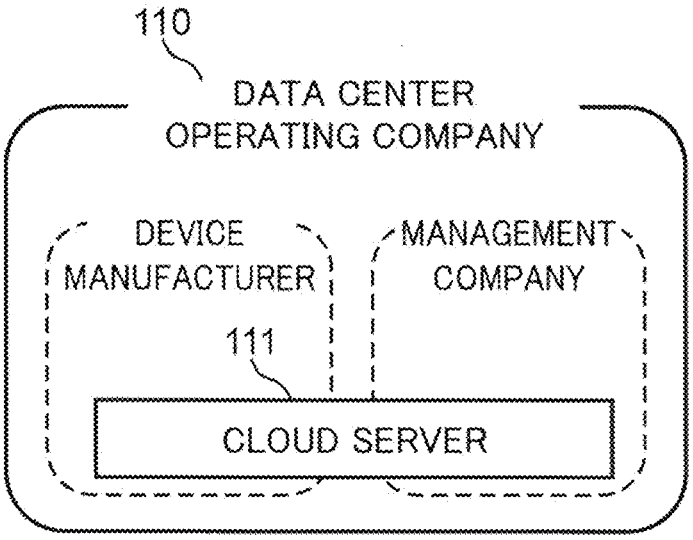
FIG. 1C is a diagram showing yet another example of an overview of a system configuration when providing a service for remotely controlling a device installed inside a house to a user.

A data center operating company 110 includes a cloud server 111. The cloud server 111 is a virtual server that links with various devices via the Internet. The cloud server 111 mainly manages huge data (big data) and the like which are difficult to handle using general database management tools or the like. The data center operating company 110 manages data, manages the cloud server 111, and operates a data center that performs such management. Details of services provided by the data center operating company 110 will be described later. In this case, the data center operating company 110 is not limited to companies that only manage data or only operate the cloud server 111. For example, when a device manufacturer responsible for developing and manufacturing a device among the plurality of devices 101 also manages data or manages the cloud server 111, the device manufacturer corresponds to the data center operating company 110 (FIG. 1B). In addition, the data center operating company 110 is not limited to one company. For example, when a device manufacturer and separate management company manage data or manage the cloud server 111 in cooperation or in a shared manner, both of or one of the device manufacturer and the management company correspond to the data center operating company 110 (FIG. 1C).

The service provider 120 includes a server 121. The server 121 as referred to herein may be of any scale and includes, for example, a memory in a personal PC. In addition, there may be cases where the service provider 120 does not include the server 121.

Moreover, in the service described above, the home gateway 102 is not essential. For example, the home gateway 102 is unnecessary in a case where the cloud server 111 performs all data management. In addition, there may be cases where there are no devices that are incapable of connecting to the Internet by themselves such as when all devices in the home are connected to the Internet.

Next, a flow of information in the service will be described.

First, the device A or the device B in the group 100 transmits respective pieces of log information to the cloud server 111 of the data center operating company 110. The cloud server 111 accumulates log information of the device A or the device B ((a) in FIG. 1A). In this case, log information is information indicating an operation state, an operation date/time, or the like of the plurality of devices 101. For example, log information includes a viewing history of a television set, video recording reservation information of a recorder, an operation date/time of a washing machine, an amount of laundry, an opening/closing time/date of a refrigerator, the number of times a refrigerator had been opened/closed, or the like. However, log information is not limited to these types of information and may include various types of information that can be acquired from various types of devices. The log information may be directly provided by the plurality of devices 101 themselves to the cloud server 111 via the Internet. Alternatively, the log information may be temporarily accumulated by the home gateway 102 from the plurality of devices 101 and provided to the cloud server 111 by the home gateway 102.

Next, the cloud server 111 of the data center operating company 110 provides the accumulated log information to the service provider 120 in fixed units. In this case, the fixed unit may be a unit that can be provided by the data center operating company 110 to the service provider 120 by organizing accumulated information or a unit that is requested by the service provider 120. While information is to be provided in fixed units as described above, information need not necessarily be provided in fixed units and an amount of information to be provided to the service provider 120 may vary according to circumstances.

When necessary, the log information is stored in a server 121 owned by the service provider 120 ((b) in FIG. 1A). Subsequently, the service provider 120 organizes the log information into information matching the service to be provided to the user and provides the organized information to the user. The user to which the log information is provided may be the user 10 of the plurality of devices 101 or an outside user 20. As for a method of providing information to a user, for example, the information may be directly provided to the user 20 by the service provider 120 ((b) and (e) in FIG. 1A). In addition, as for a method of providing service to a user, for example, the service may be provided to the user 10 once again via the cloud server 111 of the data center operating company 110 ((c) and (d) in FIG. 1A). Furthermore, the cloud server 111 of the data center operating company 110 may organize the log information into information matching the service to be provided to the user and provide the organized information to the service provider 120.

Moreover, the user 10 may differ from the user 20 or may be the same as the user 20.

Embodiment

Figure 2:
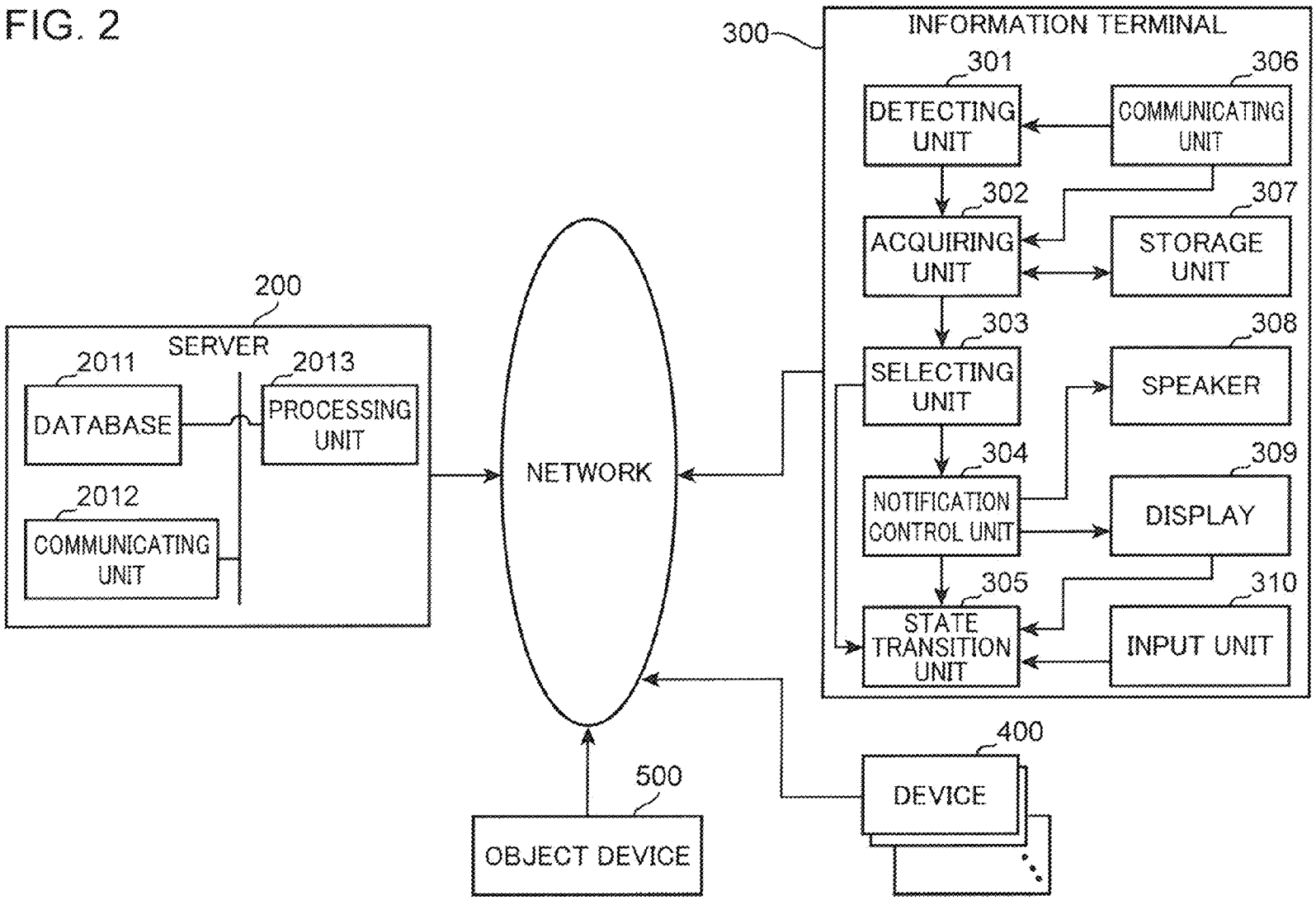
FIG. 2 is a block diagram showing an example of an overall configuration of a remote control system according to an embodiment.

FIG. 2 is a block diagram showing an example of an overall configuration of a remote control system according to an embodiment. The present remote control system includes a server 200, an information terminal 300, a device 400, and an object device 500.

The server 200 is, for example, a cloud server constituted by one or more computers. In this case, the server 200 periodically acquires an electrical home appliance log associated with a state, a time of acquisition of the state, and a user ID from the device 400 and the object device 500 and manages the device 400 and the object device 500.

The information terminal 300 is constituted by, for example, a mobile terminal (such as a smartphone, a mobile phone, and a tablet terminal) that is carried by the user. Alternatively, the information terminal 300 may be constituted by a navigation device mounted to an automobile or a bicycle of the user.

An electric appliance to be a remote control object is adopted as the device 400. All devices that can be remotely controlled correspond to the device 400 including an electric thermos pot, an induction cooker, a washing machine, a microwave oven, a television, an AV device, a recorder apparatus, an air conditioner, an electric shutter, and an electric curtain.

The object device 500 is an electric appliance for which a device state is acquired. In this case, a device state refers to data used to identify a situation inside a house of a user. For example, if the object device 500 is a television set, a viewed television program is adopted. Moreover, as the object device 500 any electric appliance among the devices 400 may be adopted or an electric appliance other than the devices 400 may be adopted.

FIG. 1 shows a remote control system applied to one user. Therefore, in FIG. 1, electric appliances installed in a house of the one user are shown as the device 400 and the object device 500, and an information terminal 300 that is carried by the one user is shown as the information terminal 300. However, in reality an information terminal 300 carried by another user and a device 400 and an object device 500 installed inside a house of the other user are also connected to the server 200.

The server 200, the information terminal 300, the device 400, and the object device 500 are connected so as to be capable of communicating with each other via a network. In this case, the device 400 and the object device 500 are connected via a LAN inside the house. As the LAN, either a wireless LAN or a wired LAN may be adopted. In addition, when the user is inside the house, the information terminal 300 is connected to the device 400 and the object device 500 through the LAN. When the user is outside the house, the information terminal 300 is connected to the device and the object device 500 through a WAN. As the WAN, the Internet or a mobile phone communication network can be adopted. Furthermore, the server 200 is connected to the information terminal 300, the device 400, and the object device 500 through the WAN.

Figure 10:
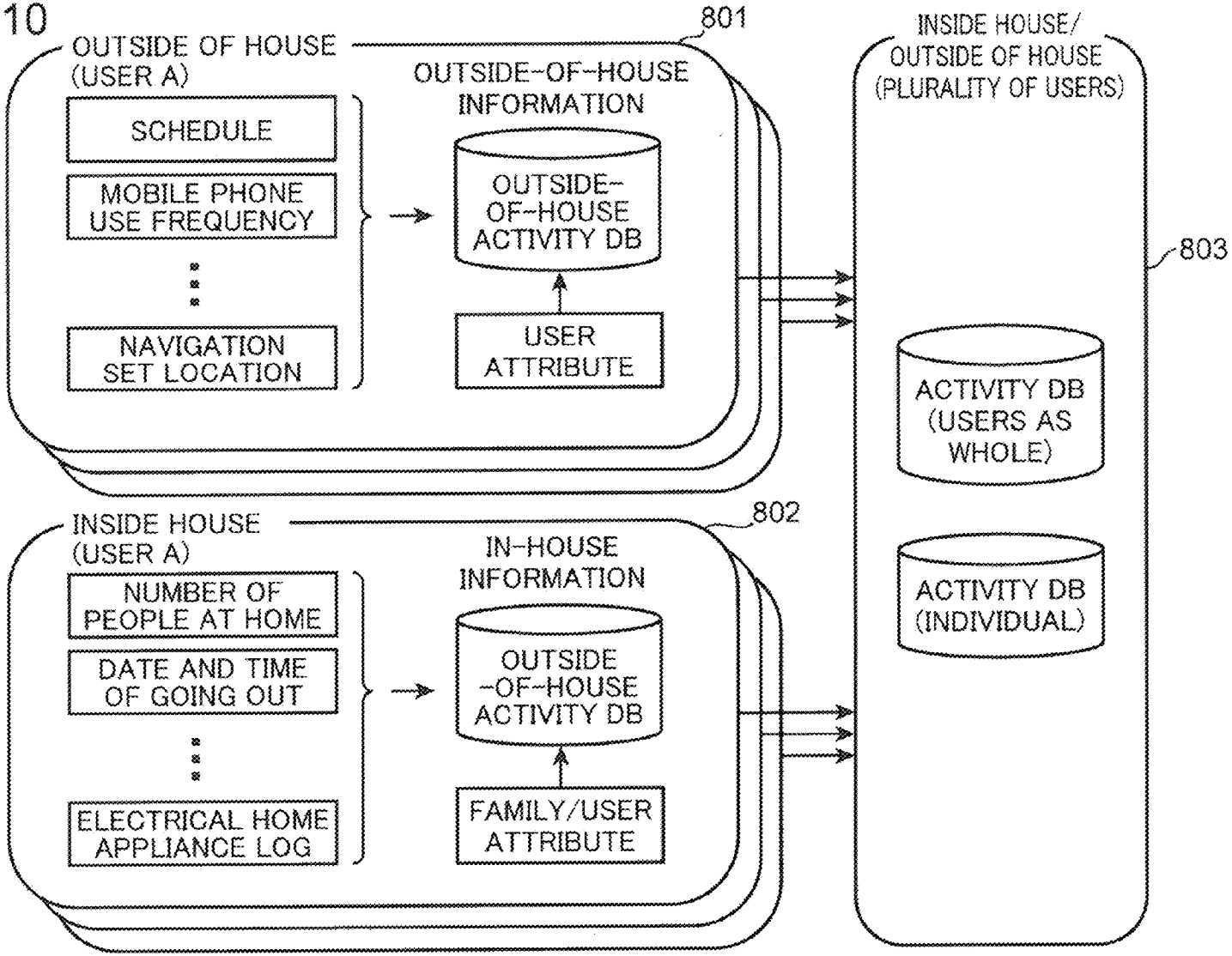
FIG. 10 is a conceptual diagram of outside-of-house information and in-house information.

Hereinafter, detailed configurations of the server 200 and the information terminal 300 will be described. The server 200 includes a database 2011, a communicating unit 2012, and a processing unit 2013. The database 2011 stores various types of data necessary for realizing the present remote control system. In the present disclosure, as shown in FIG. 10, the database 2011 stores outside-of-house information 801 and in-house information 802 for each user and stores stored information 803 generated from outside-of-house information 801 and in-house information 802 of a plurality of users.

The processing unit 2013 is, for example, constituted by a processor such as a CPU and is responsible for overall control of the server 200. In the present disclosure, the processing unit 2013 stores the outside-of-house information 801, the in-house information 802, and the stored information 803 described above in the database 2011 and manages the database 2011.

The communicating unit 2012 is constituted by a communication device that connects the server 200 to the network.

The information terminal 300 includes a detecting unit 301, an acquiring unit 302, a selecting unit 303, a notification control unit 304, a state transition unit 305, a communicating unit 306, a storage unit 307, a speaker 308, a display 309, and an input unit 310.

The detecting unit 301 detects the user going out or the user coming home. When the information terminal 300 is constituted by a mobile terminal carried by the user or a car navigation device, the detecting unit 301 includes a GPS sensor and detects the user going out or the user coming home based on a position of the user as detected by the GPS sensor. In addition, when the information terminal 300 is constituted by a mobile terminal, the detecting unit 301 acquires information on a base station of the mobile terminal through the communicating unit 306 and may detect the user going out or the user coming home by identifying a base station with which the information terminal 300 is communicating from the information on the base station. Furthermore, the detecting unit 301 may detect the user going out or the user coming home according to whether or not the communicating unit 306 had been able to communicate with a specific electric appliance inside the house by near field wireless communication.

Alternatively, the detecting unit 301 may acquire, through the communicating unit 306, a notification indicating that the user has come home or has gone out from an intercom attached to a door of the user's house and may detect the user going out or the user coming home based on the notification.

Alternatively, the detecting unit 301 may acquire, through the communicating unit 306, a notification indicating that a lock attached to an entrance door of the user's house has been opened from the outside or opened from the inside, and may detect the user going out or the user coming home based on the acquired notification.

In addition, the detecting unit 301 detects an in-house state. For example, the number of people at home indicating the number of people inside the house corresponds to the in-house state. In this case, the detecting unit 301 detects the number of people at home using a result of detection with respect to people from an electric appliance (for example, an air conditioner or a television set) including a person detecting sensor. In addition, if the number of members of a family is registered in advance, the detecting unit 301 may detect the number of people at home using the number of members of the family and a result of detection of members going out or the members coming home. For example, when a family has five members, the detecting unit 301 sets a default number of people at home to 5. In addition, the detecting unit 301 may update the number of people at home by subtracting 1 from the number of people at home every time one member of the family goes out and adding 1 to the number of people at home every time one member of the family comes home.

The acquiring unit 302 acquires a current setting state of the device 400 when the detecting unit 301 detects the user going out or the user coming home. In this case, as the setting state, an on state or an off state of power of the device 400, a current operation state of the device 400, or an operation mode is adopted. In addition, the acquiring unit 302 acquires a current device state of the object device 500 when the detecting unit 301 detects the user going out or the user coming home.

In this case, the acquiring unit 302 may transmit a request for acquiring an electrical home appliance log to the server 200 and acquire a current setting state of the device 400 and a current device state of the object device 500 from an electrical home appliance log transmitted as a response by the server 200. Alternatively, the acquiring unit 302 may directly communicate with the device 400 and the object device 500 and acquire a current setting state and a current device state.

In addition, when the detecting unit 301 detects the user going out or the user coming home, the acquiring unit 302 causes the detecting unit 301 to detect the number of people at home and acquires a current number of people at home.

Furthermore, the acquiring unit 302 associates a date and time of going out or a date and time of coming home with the current setting state of the device 400 and uploads the same to the server 200 or stores the same in the storage unit 307. Accordingly, a setting state history such as those shown in FIGS. 6A and 6B is stored in the database 2011 and the storage unit 307. At this point, the server 200 manages the uploaded data by dividing the data per user.

In addition, the acquiring unit 302 associates a date and time of going out or a date and time of coming home with the current device state of the object device 500 and a current number of people at home, and uploads the same to the server 200 or stores the same in the storage unit 307. Accordingly, an in-house history such as those shown in FIGS. 7A and 7B is stored in the database 2011 and the storage unit 307. At this point, the server 200 manages the uploaded data by dividing the data per user.

Furthermore, when the detecting unit 301 detects the user going out or the user coming home, the acquiring unit 302 acquires outside-of-house information 801, in-house information 802, and stored information 803 from the server 200. In addition, the acquiring unit 302 acquires a setting state history per user such as those shown in FIGS. 6A and 6B as well as an in-house history per user such as those shown in FIGS. 7A and 7B from the acquired data. Alternatively, the acquiring unit 302 may acquire a setting state history and an in-house history of a user in the same house from the storage unit 307. In this case, the acquiring unit 302 may acquire a setting state history and an in-house history of other users from the server 200 when necessary.

The selecting unit 303 selects a usual setting state in accordance with the current device state and the in-house state (the number of people at home) acquired by the acquiring unit 302 from the setting state history acquired by the acquiring unit 302. In addition, the current setting state acquired by the selecting unit 303 and the acquiring unit 302 is compared with the selected usual setting state and a judgment is made on whether or not both setting states match each other.

For example, when the acquiring unit 302 acquires the setting state history shown in FIGS. 6A and 6B and the in-house history shown in FIGS. 7A and 7B, the selecting unit 303 performs a cluster process that uses in-house states and device states as input data on the in-house history of the user inside the same house. In addition, the selecting unit 303 selects a most numerous setting state among the setting states corresponding to a cluster to which the current in-house state and the device state belong from the setting state history. In this case, the selected setting state becomes a usual setting state corresponding to the current in-house state and the device state. Furthermore, the selecting unit 303 judges whether or not the selected usual setting state and the current setting state match each other.

When the selecting unit 303 judges that the setting states do not match each other, the notification control unit 304 executes a first notification for notifying the user that the current setting state differs from the usual setting state. At this point, the notification control unit 304 may execute the first notification by outputting an image representing the first notification to the display 309 or outputting a sound representing the first notification from the speaker 308.

On the other hand, when the selecting unit 303 judges that the setting states match each other, the notification control unit 304 executes a second notification for notifying the user that the current setting state is the same as the usual setting state. At this point, the notification control unit 304 may execute the second notification using an image or sound in a similar manner to the first notification.

When the first notification is executed by the notification control unit 304, the state transition unit 305 causes the state of the information terminal 300 to transition to a standby state for an operation input in order to restore the setting state of the device 400 to the usual setting state. In addition, when the operation input is accepted by the input unit 310, the state transition unit 305 generates a control command for restoring the setting state of the device 400 which differs from the usual setting state to the usual setting state and transmits the control command to the corresponding device 400.

The communicating unit 306 is constituted by a wireless LAN, a wired LAN, and communication devices such as a modem and a near field wireless communication device, and connects the information terminal 300 to the network.

The storage unit 307 is constituted by, for example, a non-volatile rewritable storage device and stores a setting state history and an in-house history.

The speaker 308 outputs sound under the control of the notification control unit 304 and executes the first and second notifications. The display 309 is constituted by a display panel such as a liquid crystal panel, and outputs an image under the control of the notification control unit 304 to execute the first and second notifications to the user.

For example, when the display 309 is constituted by a touch panel type display panel, the input unit 310 is constituted by a touch panel. In addition, when the information terminal 300 is constituted by a desk top computer, the input unit 310 is constituted by an input device such as a mouse or a keyboard.

Figure 3:
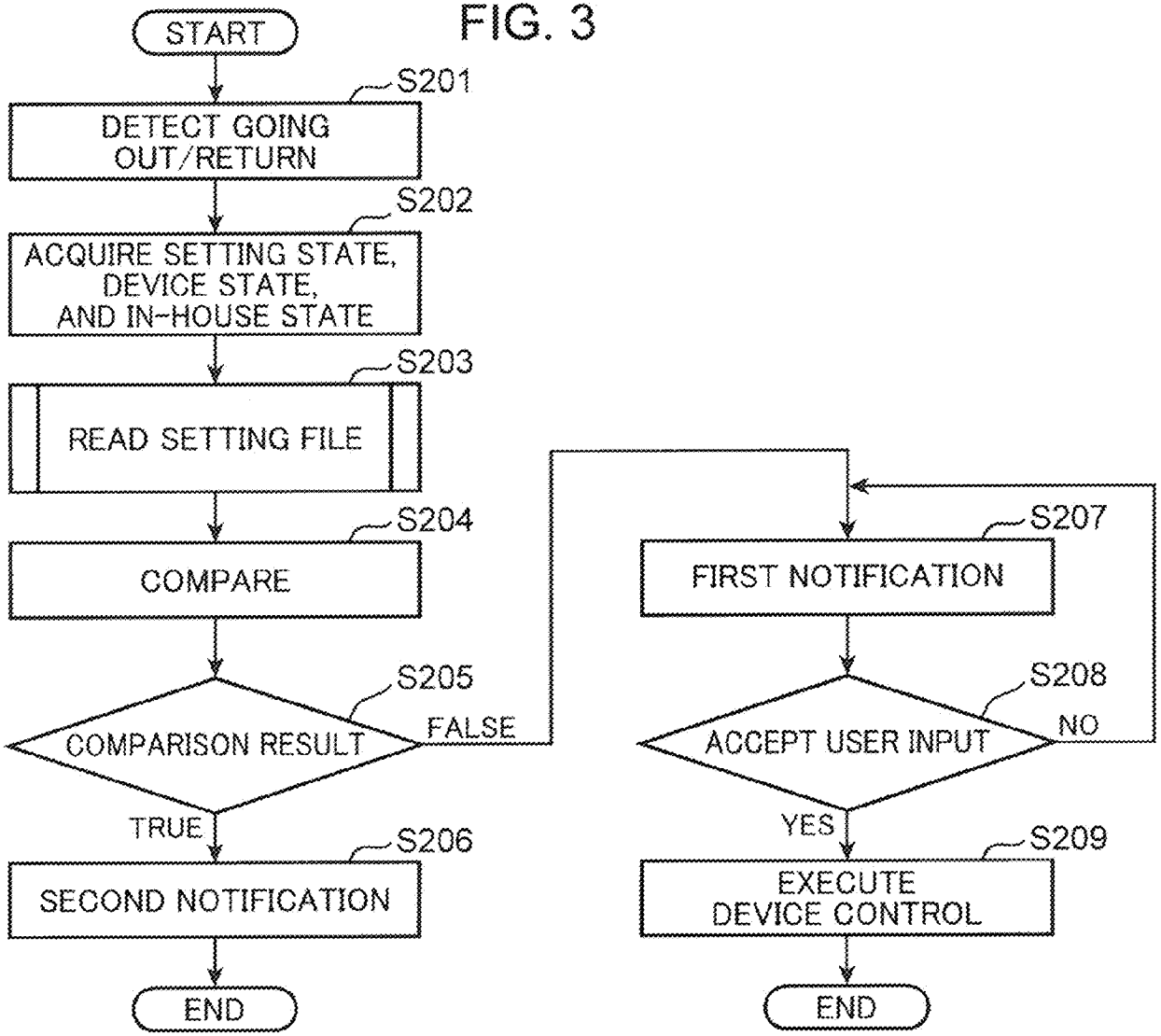
FIG. 3 is a diagram showing a process flow of a remote control system according to an embodiment.

FIG. 3 is a diagram showing a process flow of a remote control system according to the embodiment. In the present disclosure, a detection of a user going out is made as a position of the user changes from inside of the house to the outside of the house, and a detection of the user coming home is made as the position of the user changes from outside of the house to the inside of the house. In addition, when a detection of the user going out or a detection of the user coming home is made, a setting state of a remotely controllable device 400 is acquired. Furthermore, if the acquired setting state differs from a usual setting state inside the house of the user, the first notification representing the difference is presented to the information terminal 300 of the user. On the other hand, if the acquired setting state is the same as the usual setting state inside the house of the user, the second notification indicating that the setting states are the same is presented to the information terminal 300 of the user.

Moreover, in the present disclosure, the inside of the house includes, for example, a detached house and an apartment. In the case of a detached house, in addition to inside of a building, the inside of the house may include the land on which the building stands. In addition, in the case of an apartment, the inside of one dwelling unit corresponds to the inside of the house. Alternatively, in the present disclosure, a movement of the user from a region surrounding the house to the outside of the house may be considered the user going out. Alternatively, in the present disclosure, a movement of the user from the outside of the house to a region surrounding the house may be considered the user coming home.

In S201, the detecting unit 301 detects the user going out or the user coming home. Detection of the user going out or the user coming home can be realized by various methods. For example, let us assume that the information terminal 300 is constituted by a mobile phone or a mobile terminal such as a smartphone carried by the user or a navigation device that travels together with the user. In this case, detection of the user going out or the user coming home is made using a position sensed by a GPS sensor included in the mobile phone or the navigation device. In addition, in this case, when the position sensed by the GPS sensor of the mobile phone or the navigation device indicates that the user has moved from inside of the region of the house to the outside of the region of the house, the detecting unit 301 may judge that the user has gone out, and when the opposite occurs, the detecting unit 301 may judge that the user has come home.

Furthermore, when the mobile terminal starts communicating with a base station other than a base station responsible for a communication area including the user's house, the detecting unit 301 may judge that the user has gone out. On the other hand, when the mobile terminal starts communicating with the base station responsible for the communication area including the user's house, the detecting unit 301 may judge that the user has come home.

Alternatively, a detection of the user going out or the user coming home may be made using a communication result with a device with a fixed position. For example, a refrigerator or a microwave oven is unlikely to be moved from the inside of the house to the outside of the house. Therefore, when the information terminal 300 starts near field wireless communication (for example, by NFC or Bluetooth (registered trademark)) with these devices, the detecting unit 301 judge that the user has come home. On the other hand, when the information terminal 300 is no longer capable of near field wireless communication with these devices, the detecting unit 301 may judge that the user has gone out.

Alternatively, a detection of the user going out or the user coming home may be made using a facial recognition device included in an intercom attached to a door of the user's house. For example, when the intercom is pressed, the facial recognition device captures an image of the face of a user having pressed the intercom and extracts a feature quantity of the face, judges that the user has come home if the extracted feature quantity matches a feature quantity of a face registered in advance, and performs a coming home notification to the detecting unit 301. In addition, when a coming home notification is received from the facial recognition device, the detecting unit 301 may judge that the user has come home.

Alternatively, in a case where the information terminal 300 is constituted by a navigation device, when the user sets the user's house as a destination and inputs an indication that the user is to come home, the detecting unit 301 may judge that the user has come home.

Alternatively, when a lock attached to an entrance door of the user's house is closed from the inside, the detecting unit 301 may judge that the user has come home. On the other hand, when the same lock is closed from the outside, the detecting unit 301 may judge that the user has gone out. In this case, a sensor for sensing whether the lock has been closed from the inside or closed from the outside as well as a communication device are attached to the lock. In addition, when the sensor senses that the lock has been closed from the inside or closed from the outside, the communication device transmits the sensing result to the detecting unit 301. Furthermore, the detecting unit 301 may detect that the user going out or the user coming home using a detection result transmitted from the communication device.

As described above, a detection of the user going out or the user coming home may be made using an indication that the user is to go out or come home in addition to using an actual movement of the user.

In S202, the acquiring unit 302 acquires a current setting state of the device 400, a current device state of the object device 500, and a current in-house state. In this case, the acquiring unit 302 may acquire the setting state and the device state by directly communicating with the device 400 and the object device 500. Alternatively, when the setting state is managed by the server 200, the acquiring unit 302 may acquire the setting state of the device 400 and the device state of the object device 500 from the server 200.

In S203, the selecting unit 303 executes a reading process of a setting file indicating a usual setting state of the device 400. Details of this process will be described later.

In S204, the selecting unit 303 compares a setting state indicated in the read setting file with a current setting state.

When the result of the comparison is true (TRUE in S205) or, in other words, when the current setting state of all devices 400 matches the setting state indicated in the setting file, the notification control unit 304 executes a second notification indicating that the current setting state is the same as the usual setting state (S206).

Figure 4A:
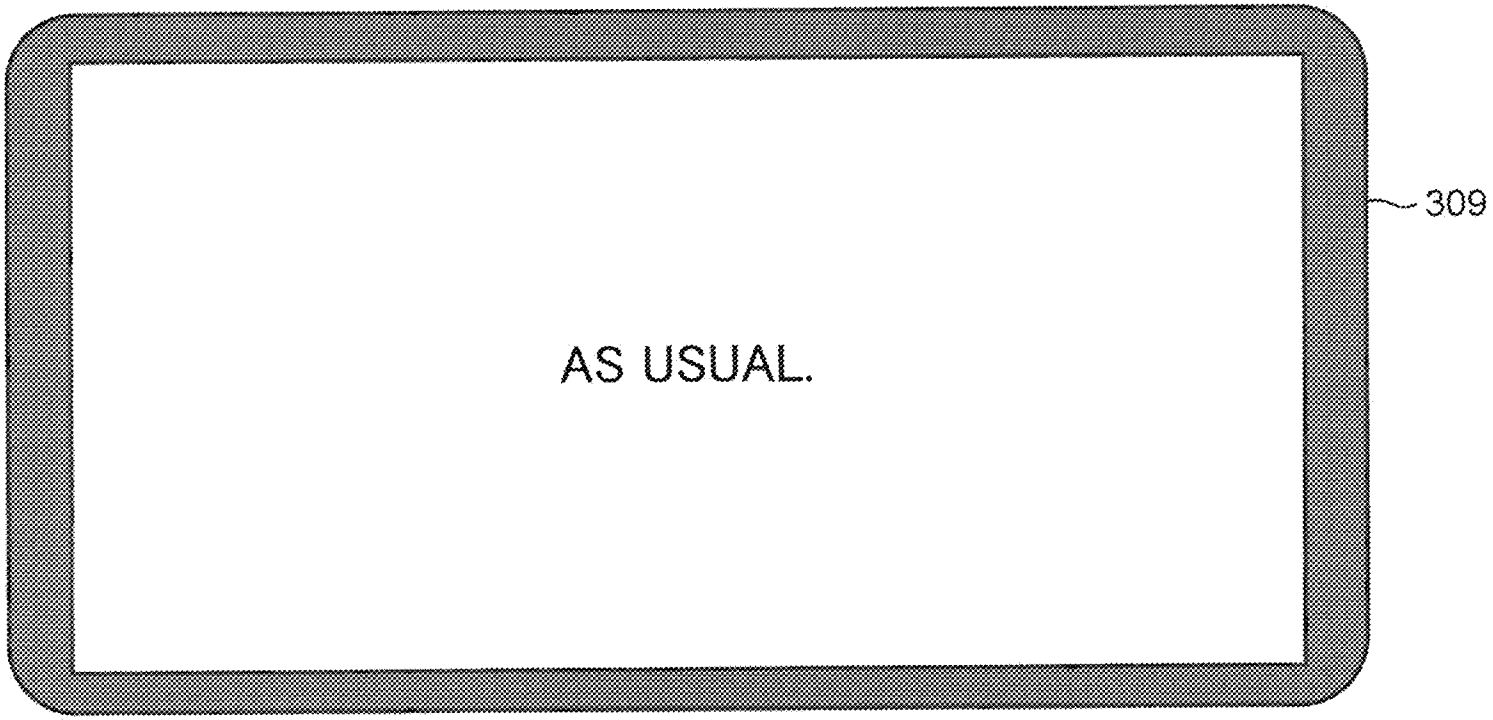
FIG. 4A is a diagram showing a first example of a second notification.

FIG. 4A is a diagram showing a first example of the second notification. In the example shown in FIG. 4A, the notification control unit 304 outputs a screen describing a text reading "As usual" which indicates that the current setting state of the device 400 is the same as the usual setting state to the display 309. Due to the second notification, when going out, the user can recognize that the setting state of the device 400 is the same as the usual setting state and can feel reassured. On the other hand, when the user is at home, the user can determine that intrusion by a third party has not occurred while the user was out since the setting state of the device 400 is the same as the usual setting state and can feel reassured.

Figure 4B:
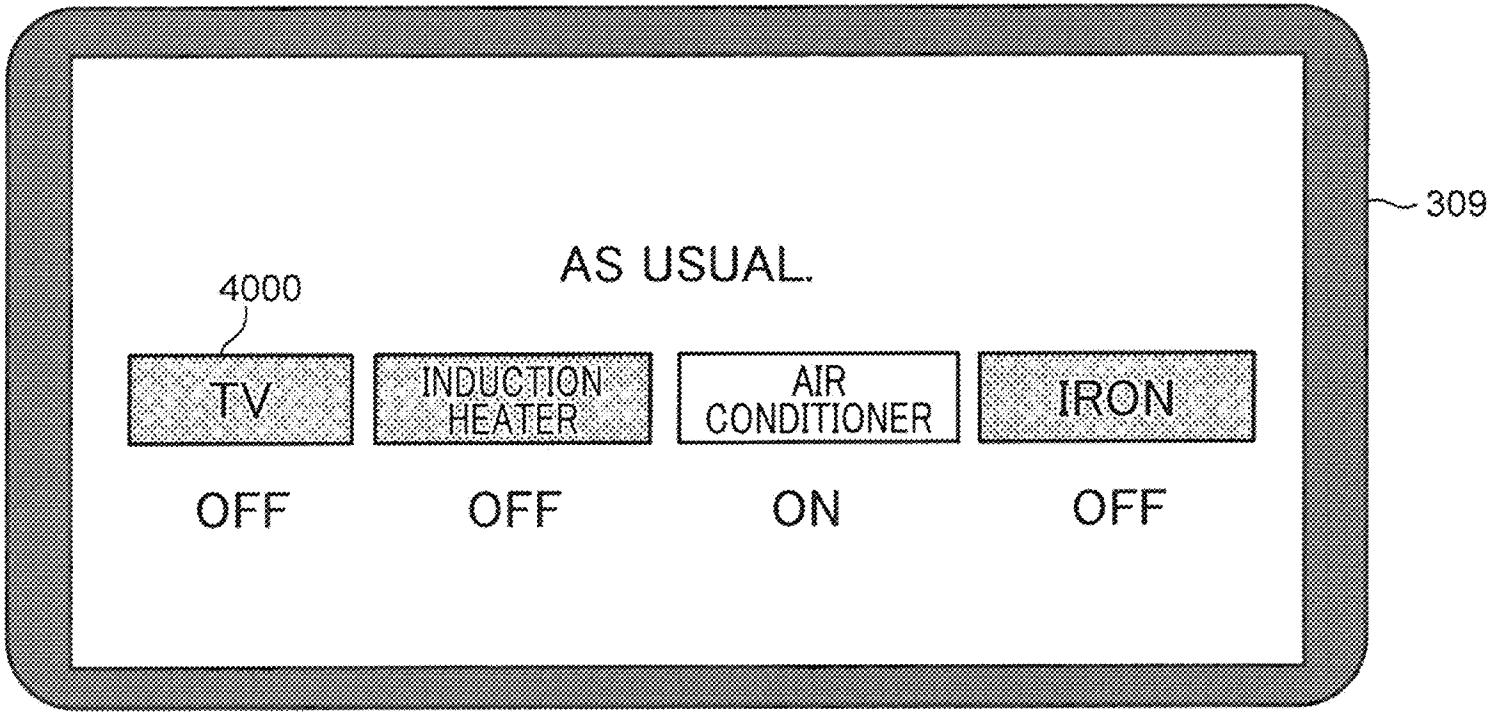
FIG. 4B is a diagram showing a second example of a second notification.

FIG. 4B is a diagram showing a second example of the second notification. In the second example, in addition to a text reading "As usual" which indicates that the current setting state of the device 400 is the same as the usual setting state, the notification control unit 304 further outputs a screen including information for visually and explicitly showing a setting state of each device 400 to the display 309. Accordingly, a specific setting state is additionally notified and the user can feel even more reassured. In this example, the setting state of the device 400 is shown using an icon 4000 indicating a name of the device 400. Furthermore, in this example, a text indicating the setting state of the device 400 is also displayed below the icon 4000.

In this case, a television set (TV), an induction cooker, an air conditioner, and an iron are adopted as the device 400. In addition, the setting states of the TV, the induction cooker, and the iron are off states. Therefore, the icons 4000 of the TV, the induction cooker, and the iron are displayed in gray and a text reading "off" is displayed below each icon 4000. On the other hand, the setting state of the air conditioner is an on state. Therefore, the icon 4000 of the air conditioner is displayed in white and a text reading "on" is displayed below the icon 4000 of the air conditioner.

Moreover, while texts respectively reading "As usual", "on", and "off" are displayed in the second example of the second notification, this is merely an example. For example, a mode may be adopted where the texts are hidden and the setting state of the device 400 is notified using only the icon 4000.

In addition, while a mode where the icon 4000 of the device 400 in an off state is displayed in gray and the icon 4000 of the device 400 in an on state is displayed in white has been presented in the example shown in FIG. 4B, this is merely an example and other colors may be adopted as long as the colors are capable of making the user aware that the device 400 is in an on state or an off state. Alternatively, a mode may be adopted where brightness of the icon 4000 of the device 400 in an on state is set higher than brightness of the icon 4000 of the device 400 in an off state. Alternatively, a mode may be adopted where the icon 4000 of the device 400 in an on state displayed so as to blink and the icon 4000 of the device 400 in an off state is displayed so as not to blink.

Returning now to FIG. 3, if the comparison result is false (FALSE in S205) or, in other words, if there is at least one device 400 whose current setting state differs from the usual setting state, the notification control unit 304 executes a first notification indicating that the current setting state of the device 400 differs from the usual setting state (S207).

In S208, the state transition unit 305 enters a standby state for an operation input by the user using the input unit 310.

Figure 5A:
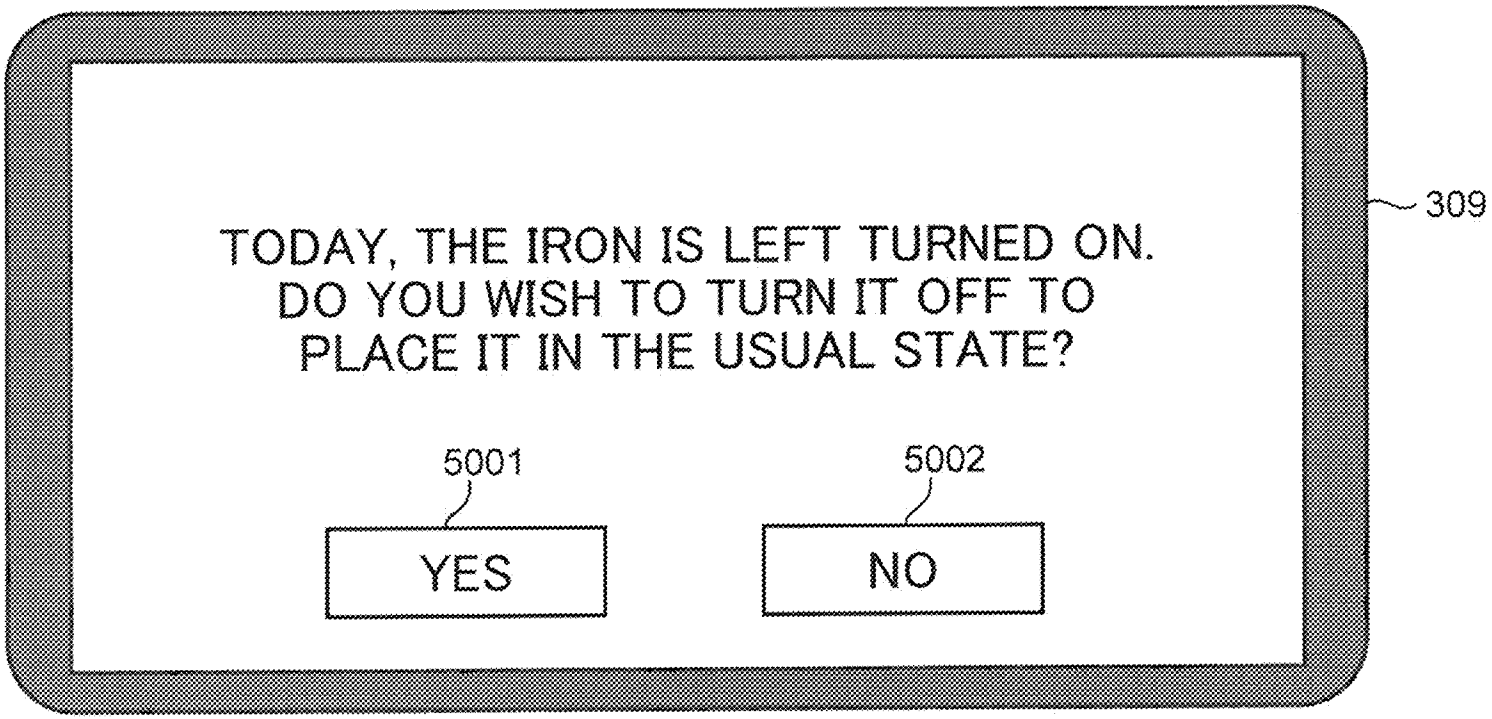
FIG. 5A is a diagram showing a first example of a first notification.

FIG. 5A is a diagram showing a first example of the first notification. In the first example of the first notification, the notification control unit 304 outputs a screen describing a text reading "Today, the iron is left turned on" which indicates that the current setting state of the device 400 differs from the usual setting state to the display 309. Accordingly, the attention of the user can be attracted to the fact that the current setting state of the device 400 differs from the usual setting state.

When the first notification is executed, it is highly likely that the setting state of the device 400 differs from the usual setting state and an operation input for restoring the setting state of the device 400 to the usual setting state is to be accepted from the user. Therefore, in the example shown in FIG. 5A, an inquiring message reading "Do you wish to turn off the iron which is the usual state?" is displayed. In this case, since the setting state of the iron differs from the usual setting state and is an "on" state, a message reading "Today, the iron is left turned on" which indicates that the iron is in an "on state" is also displayed.

In addition, a "yes" icon 5001 for executing a process to restore the setting state of the device 400 to the usual setting state and a "no" icon 5002 that prevents the process from being executed are displayed below the message. Accordingly, the state transition unit 305 enters a standby state for an operation input from the user. In this case, by simply inputting an operation for selecting the icon 5001, the user can restore the setting state of the device 400 whose setting state differs from usual to the usual setting state. On the other hand, there may be cases where the user has, for this time, intentionally set the setting state of a given device 400 to a setting state that differs from usual. In such a case, by simply inputting an operation for selecting the icon 5002, the user can maintain the setting state of a corresponding device 400 to a setting state which differs from usual.

Figure 5B:
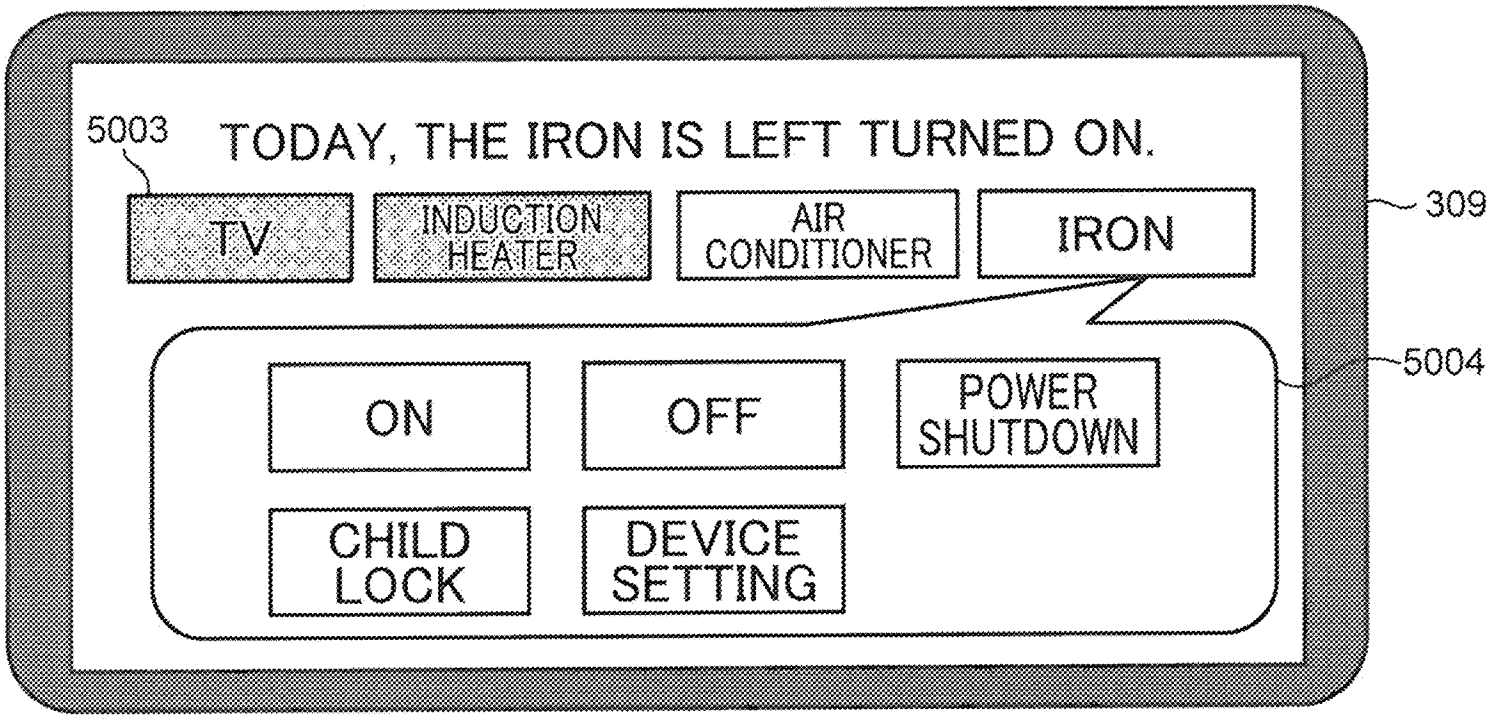
FIG. 5B is a diagram showing a second example of a first notification.

FIG. 5B is a diagram showing a second example of the first notification. In the example shown in FIG. 5B, in place of a message that guides the setting state of the device 400 whose setting state differs from usual to be restored to the usual setting state, icons 5003 indicating current setting states of all devices 400 and an operation dialog 5004 of a device 400 whose setting state differs from usual are displayed on the display 309.

In this case, since a TV, an induction cooker, an air conditioner, and an iron are adopted as the devices 400, four icons 5003 indicating setting states of the devices are displayed. In this example, since the respective setting states of the TV, the induction cooker, the air conditioner, and the iron are an "off" state, an "off" state, an "on" state, and an "on" state, the icons 5003 of the TV and the induction cooker are displayed in gray and the icons 5003 of the air conditioner and the iron are displayed in white. In addition, while the setting states of the TV, the induction cooker, and the air conditioner are the same as usual, the setting state of the icon differs from usual and is an "on" state.

Therefore, in the example shown in FIG. 5B, a message reading "Today, the iron is left turned on" which indicates a device 400 whose setting state differs from usual to the user is displayed. In addition, in association with the icon 5003 of the iron whose setting state differs from usual, an operation dialog 5004 for operating the iron is displayed. Various buttons for operating the iron are displayed in the operation dialog 5004. In the example shown in FIG. 5B, buttons representing "on", "off", "power shutdown", "child lock", and "device setting" are included in the operation dialog 5004. Therefore, with respect to the device 400 whose setting state differs from usual, the user can input not only an operation for restoring or not restoring the setting state to the usual setting state but more meticulous operations as well.

When there are a plurality of devices 400, setting states of which differ from those for usual, it is considered that the display 309 is unable to display, at one time, operation dialogs 5004 of the plurality of devices 400 due to size restrictions. In this case, when the user inputs an operation for selecting the icon 5003 of a certain device 400, the notification control unit 304 may display the operation dialog 5004 of only the device 400 on the display 309.

Returning now to FIG. 3, when the input unit 310 accepts an operation input from the user (YES in S208), the state transition unit 305 executes device control in accordance with the operation input from the user (S209). On the other hand, when the input unit 310 does not accept an operation input from the user (NO in S208), the process is returned to S208 and the standby state for an operation input is maintained.

Let us assume that, in the example shown in FIG. 5A, the user has selected the "yes" icon 5001. In this case, the state transition unit 305 outputs a control command for restoring the setting state (on state) of the corresponding device 400 (iron) to the usual setting state (off state) to the corresponding device 400 (iron). On the other hand, let us assume that the user has selected the "no" icon 5002. In this case, in order to maintain the setting state (on state) of the corresponding device 400 (iron), the state transition unit 305 does not output a control command to the corresponding device 400 (iron).

Moreover, in S208, when an operation input from the user is not accepted within a certain period of time, the state transition unit 305 may end the process without outputting a control command.

As described above, when the setting state of the device 400 is the same setting state as usual, the second notification is executed. In this case, the second notification is an unobtrusive notification that only includes a message stating that the setting state of the device 400 is the same as usual and does not compel the user to perform an operation for input a response confirming that the message has been confirmed. Therefore, every time the second notification is performed, the user is freed from the trouble of inputting a confirmation response and operation stress is reduced. In addition, the second notification includes a message stating that the setting state of the device 400 is the same as usual. Therefore, the user can gain a sense of reassurance.

On the other hand, the first notification is executed when the setting state of the device 400 differs from usual. In this case, the first notification includes information indicating a device 400 whose setting state differs from usual, a button that enables the setting state of the device 400 to be restored to a usual setting state, and the like. Accordingly, for example, since the user can be made aware upon going out that the user has forgot to turn off power of the device 400, the user can turn off power of the corresponding device 400 and go out feeling reassured.

When performing remote control, the user cannot visually confirm an actual operation state of the device 400 that is a control object. Therefore, given the user a feeling of reassurance in this manner is an important factor in remote control.

<Generation of Setting File of Device by Learning>

By generating a setting file indicating a usual setting state of the device 400 that is a remote control object by learning usual activities of the user, a further improvement in user operability can be achieved. Specifically, by causing a setting file to be generated by learning, a setting file more adapted to life activities of the user is generated. In addition, the setting file is compared with a current setting state of the device 400, and if the current setting state is the same as usual, the simplified second notification is performed.

On the other hand, the first notification is performed when the current setting state differs from usual and the user can remotely control the device 400. In addition, even when the user is not conscious of a usual operation performed with respect to the device 400, a setting file adapted to life activities of the user is created and the device 400 can be remotely controlled according to the setting file. Furthermore, even when learning is meticulously performed, since the first notification is performed only when there is a difference from the usual as described earlier, the amount of operation stress on the user is small.

Next, before describing details of generation of a setting file, an outline of generation of a setting file will be provided with reference to FIGS. 6A to 7B. FIGS. 6A and 6B are diagrams showing a setting state history which records a date and time when a user went out and a setting state of a device 400 inside the house upon going out. FIG. 6A shows a setting state history for morning and FIG. 6B shows a setting state history for afternoon. A setting state history includes a "user ID", a "date and time of going out", and a "setting state" of each device 400.

The "user ID" is an identifier of a user to which a service of the present remote control system is applied. The "date and time of going out" indicates a date and a time when a user goes out. In addition, in the examples shown in FIGS. 6A and 6B, since an electric thermos pot, an induction cooker (IHC), and a washing machine are adopted as devices 400 that are remote control objects, setting states of an "electric thermos pot", an "IHC", and a "washing machine" are recorded in the setting state history.

Taking a bottommost row in FIG. 6A as an example, it is recorded that inside the house of a user whose "user ID" is "978", detection of the user going out was made at 7:03 on April 12 and, at the time of detection of the user going out, the setting states of the electric thermos pot, the IHC, and the washing machine were respectively "hot water lock", "off", and "off". In addition, in FIGS. 6A and 6B, a latest setting state or, in other words, a current setting state is recorded in the bottommost row and a past setting state is recorded in other rows.

As shown in FIG. 6A, upon the user going out in the morning, setting states of the "electric thermos pot", the "IHC", and the "washing machine" are mostly "hot water lock", "off", and "off". On the other hand, as shown in FIG. 6B, upon the user going out in the afternoon, while the setting state of the "electric thermos pot" is "hot water lock" in a similar manner to the morning, the setting states of the "IHC" and the "washing machine" are mostly "power shutdown" and "child lock" unlike in the morning. As shown, an everyday activity pattern of a user in a given house is often repetitions of the same activities. Meanwhile, activity patterns of a user may differ between the morning and the afternoon. Therefore, needs of the user cannot be satisfied by performing fixed control such as uniformly turning off the devices 400 without distinguishing between the morning and the afternoon.

FIGS. 7A and 7B are diagrams showing an in-house history which records a date and time when a user went out, an in-house state inside the house of the same user as in FIGS. 6A and 6B. FIG. 7A shows an in-house history for morning and FIG. 7B shows an in-house history for afternoon. An in-house history includes a "user ID", a "date and time of going out", an "in-house state", and a "device state".

The "user ID" and the "date and time of going out" are the same as FIGS. 6A and 6B. The "in-house state" indicates a state inside a house where the user resides. In this case, as the "in-house state", the number of people at home inside the house immediately before the detection of the user going out is adopted. The "device state" indicates a state of the object device 500 which is installed inside the house and which is a monitoring object. In this case, a television set is adopted as the object device 500 and a viewed television program that is viewed by the user is adopted as the "device state". In this example, while the "number of people at home" and a "viewed television program" are adopted as the "in-house state" and the "device state", the present disclosure is not limited thereto. For example, as the "in-house state", "room temperature" may be adopted in place of or in addition to the "number of people at home". In addition, as the "device state", a device state of the object device 500 such as "operation information of the washing machine" may be adopted in place of or in addition to a "viewed television program". Furthermore, as the object device 500, the device 400 that is a remote control object may be adopted.

Taking a bottommost row in FIG. 7A as an example, it is recorded that inside the house of a user whose "user ID" is "978", detection of the user going out was made at 7:03 on April 12 and, at the time of detection of the user going out, the "number of people at home" including the user who went out is "3" and someone inside the house had been viewing a television program categorized as a Japanese period drama.

As shown in FIG. 7A, it is recorded that, upon the user going out in the morning, three people including the user who is to go out are in the house and one of the three had been viewing a Japanese period drama television program. Meanwhile, it is recorded that, upon the user going out in the afternoon, two people including the user who is to go out are in the house and one of the two had been viewing a children's program. In this case, the number of people viewing a television program can be identified by, for example, using a result of detection by a person detection sensor included in a television set or an air conditioner.

Furthermore, registration information of the user to go out (the user with the user ID "978") records that the user is a woman in her 40s. In addition, the in-house history shown in FIG. 7B records that the "number of people at home" is "2" and the "viewed television program" is a "children's program". Therefore, one can surmise that, in the afternoon before the user who is the mother went out, it is highly likely that the mother and two children had been home. Therefore, one can surmise that, in the setting state history shown in FIG. 6B, setting states for implementing safety measures such as "child lock" and "power shutdown" are recorded as setting states of the "IHC" and the "washing machine".

On the other hand, the in-house history shown in FIG. 7A records that the "number of people at home" is "3" and the "viewed television program" is a Japanese period drama. Therefore, one can surmise that, in the morning before the user who is the mother went out, the "3" people include the kind of adult who watches a Japanese period drama and that the three people at home are the mother, a grandfather (or a grandmother), and a child. As a result, one can surmise that, in the setting state history shown in FIG. 6A, setting states for implementing safety measures such as "power shutdown" and "child lock" are not set for the "IHC" and the "washing machine".

As described above, when a situation inside the house can be predicted to a certain degree from in-house history and, furthermore, a user goes out in a similar situation, the setting states of the devices 400 are often the same. In other words, one can say that there is a correlation between the situation inside the house upon the user going out and the setting states of the devices 400 upon the user going out. The present disclosure focuses on this point.

Figure 8:
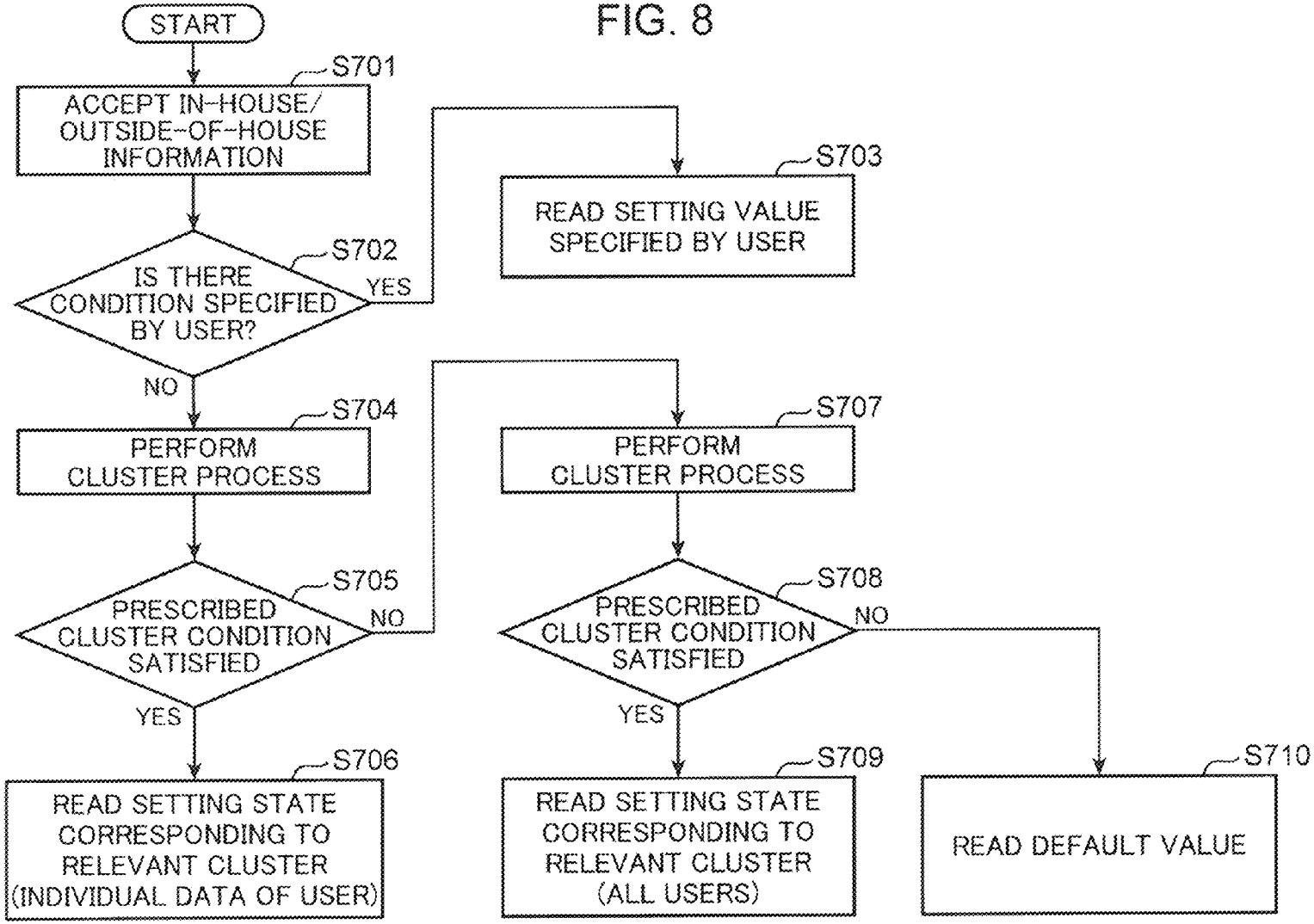
FIG. 8 is a flow chart showing details of a reading process of a setting file in S203 shown in FIG. 3.

FIG. 8 is a flow chart showing details of a reading process of a setting file in S203 shown in FIG. 3. In S701, the acquiring unit 302 acquires outside-of-house information 801 and in-house information 802 of a user inside the same house (hereinafter, referred to as a user A) from the server 200. FIG. 10 is a conceptual diagram of the outside-of-house information 801 and the in-house information 802. The server 200 manages the outside-of-house information 801 and the in-house information 802 per user.

The in-house information 802 includes the number of people at home, a date and time of going out, an electrical home appliance log, and the like. The number of people at home and the date and time of going out are the same as the "number of people at home" and the "date and time of going out" shown in FIGS. 7A and 7B. An electrical home appliance log is log information of the device 400 and the object device 500. In this case, the electrical home appliance log includes the setting states of the devices 400 shown in FIGS.

6A and 6B and the "viewed television program" of the object device 500 shown in FIGS. 7A and 7B.

In this case, a corresponding date and time of going out is respectively associated with the number of people at home and the electrical home appliance log. Therefore, the acquiring unit 302 can acquire the setting state history shown in FIGS. 6A and 6B from the electrical home appliance log. In addition, the acquiring unit 302 can acquire the in-house history shown in FIGS. 7A and 7B from the electrical home appliance log.

Moreover, the electrical home appliance logs described above are merely examples and log information of electricity usage, water usage, or opening and closing of a window may be adopted as an electrical home appliance log.

The outside-of-house information 801 includes a schedule, a mobile phone use frequency, a navigation set location, and the like. The schedule is a schedule of the user A registered to the mobile phone of the user A by the user A and is managed by the server 200. The mobile phone use frequency is a telephone call history of the mobile phone of the user A or the like and is managed by the server 200. The navigation set location is a history of destinations set by the user A to a navigation device mounted to an automobile of the user A and is managed by the server 200.

Moreover, since acquiring all outside-of-house information 801 and in-house information 802 of the user A managed by the server 200 in S701 results in an enormous amount of data, the acquiring unit 302 may acquire outside-of-house information 801 and in-house information 802 of a certain period of time in the past.

In addition, while both outside-of-house information 801 and in-house information 802 are acquired in S701, the acquiring unit 302 may only acquire in-house information 802 without acquiring outside-of-house information 801. In addition, the mobile phone use frequency may be treated as in-house information 802. Furthermore, the in-house information 802 may include a family/user attribute indicating attributes (for example, father, and age) of each of one or more family members of the user A. The outside-of-house information 801 may include attributes (for example, mother, and age) of the user A.

Furthermore, the in-house information 802 may include an in-house activity DB (database) created by processing and analyzing the number of people at home, the date and time of going out, the electrical home appliance log, and the family/user attribute. In this case, the in-house activity DB is, for example, a database representing a frequency of going out, an at-home probability, an activity history, and the like per time slot of each family member. In addition, the outside-of-house information 801 may include an outside-of-house activity DB created by processing and analyzing a schedule, mobile phone use frequency, a navigation set value, and a user attribute. In this case, the outside-of-house activity DB is, for example, a database representing a frequency of going out, an at-home probability, an activity history, and the like per time slot of the user A.

In S702, the selecting unit 303 judges whether or not a time of going out indicated by a current "date and time of going out" satisfies a condition specified by the user A. For example, let us assume that the user A has registered, in advance, a condition under which the device 400 is to be operated in a specified setting state for a time slot from 15:00 to 16:00. Let us also assume that the current "time of going out" corresponds to the time slot from 15:00 to 16:00. In this case, a judgment of YES is made in S702.

In S703, the state transition unit 305 reads a setting state specified in advance by the user A and outputs a control command for operating the device 400 in the read setting state to the device 400. On the other hand, if the current "time of going out" does not satisfy the specified condition (NO in S702), the process is advanced to S704.

Figure 11:
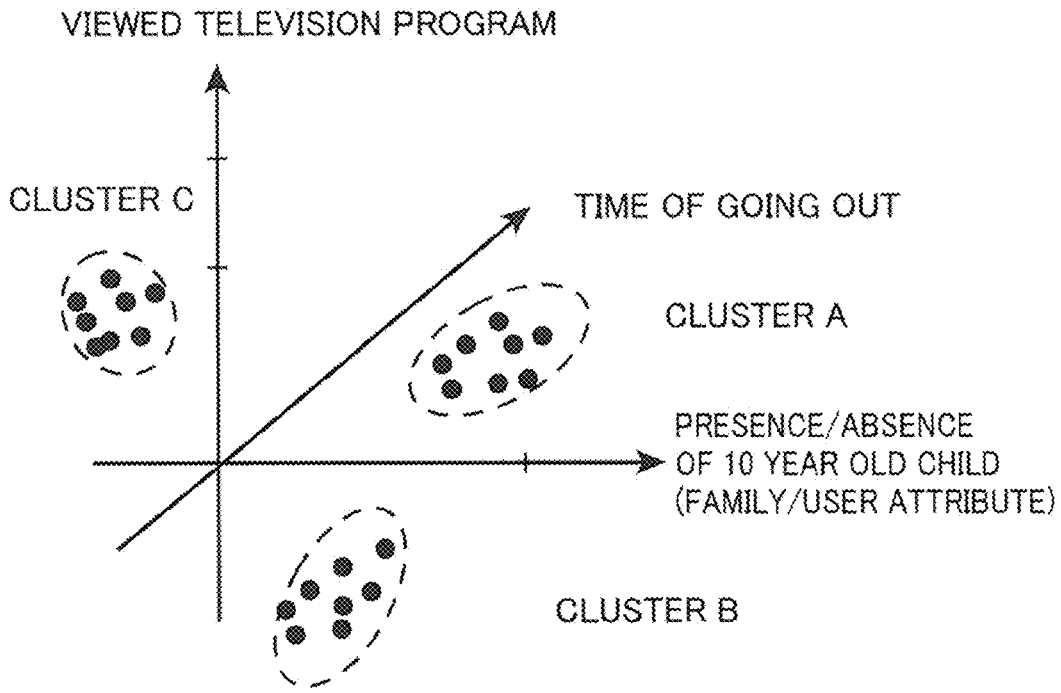
FIG. 11 is a conceptual diagram of a cluster process.

In S704, the selecting unit 303 performs a cluster process. FIG. 11 is a conceptual diagram of the cluster process. In this case, for the sake of brevity, let us assume that a cluster process of three types of data including "presence or absence of a 10 year old child", a "date and time of going out", and a "viewed television program" as process object input data. Therefore, in the example shown in FIG. 11, a result of the cluster process is represented by a three-dimensional coordinate space using three axes including an axis of the viewed television program, an axis indicating the time of going out, and an axis indication the presence or absence of a 10 year old child.

In this case, the viewed television program is the same as those shown in FIGS. 7A and 7B. The time of going out is obtained by removing information regarding month and day from the date and time of going out shown in FIGS. 7A and 7B. For example, assuming that the date and time of going out is "7:03 on July 9th", the time of going out is "7:03". The presence or absence of a 10 year old child indicates whether or not there is a 10 year old child in the family of the user. For this data, data registered in advance by the user as a family/user attribute can be adopted.

Moreover, in reality, a cluster process is performed not just on these three types of data but on various types of data acquired in S701. In this manner, by analyzing data uploaded from inside the house to the server 200 on a daily basis, the uploaded data is classified into several clusters. In the example shown in FIG. 11, the input data is classified into three clusters A, B, and C. Next, each cluster shown in FIG. 11 will be described with reference to FIG. 12.

FIG. 12 is a diagram showing characteristics of each cluster shown in FIG. 11. The cluster A represents a "situation inside the house" that features a 10 year old child belonging to the family, the user went out around 12 to 15 o'clock, and a children's program was viewed immediately before going out. In addition, an analysis of setting states corresponding to input data belonging to the cluster A revealed that the microwave oven, the television set, and the air conditioner were respectively most often set to "child lock", "no operation", and "no operation".

In this case, a setting state corresponding to input data is a setting state with the same date and time of going out as the input data. For example, assuming that the data, according to which "date and time of going out" is "19:01 on April 9th" and "viewed television program" is a "children's program", as shown in FIG. 7B is clustered as input data, setting states corresponding to this data correspond to data items, which are "hot water lock" of the "electric thermos pot", "power shutdown" of the "IHC", and "child lock" of the "washing machine", on "date and time of going out" of "19:01 on April 9th" as shown in FIG. 6B.

In other words, with respect to setting states of the microwave oven, the television set, and the air conditioner among the devices 400 upon the user going out in the "situation inside the house" indicated by the features of the cluster A, "child lock", "no operation", and "no operation" respectively represent usual setting states.

Therefore, assuming that the current situation inside the house belongs to the cluster A, if the current setting state of the device 400 is the same as the setting state shown in FIG. 12, the current setting state of the device 400 is conceivably the same as usual. On the other hand, if the current setting state of the device 400 differs from the setting state shown in FIG. 12, the current setting state of the device 400 conceivably differs from usual.

Figure 13A:
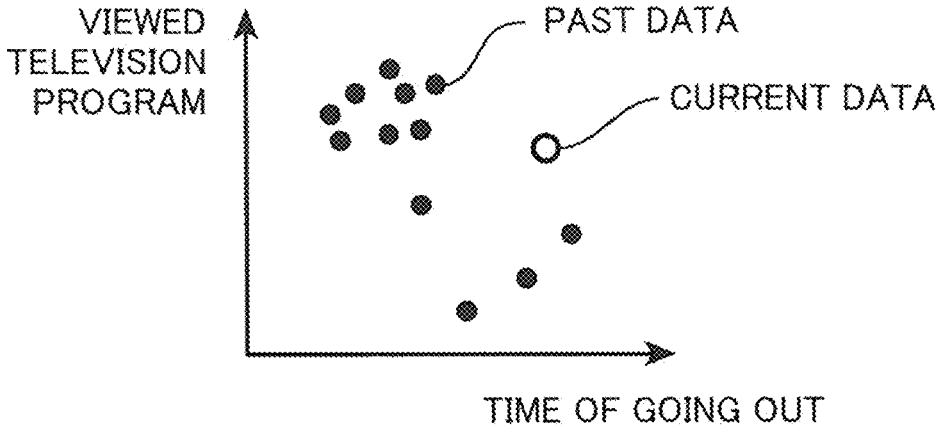
FIG. 13A is a diagram showing a cluster process when each piece of past data and current data shown in FIG. 7A or 7B is used as input data.
Figure 13B:
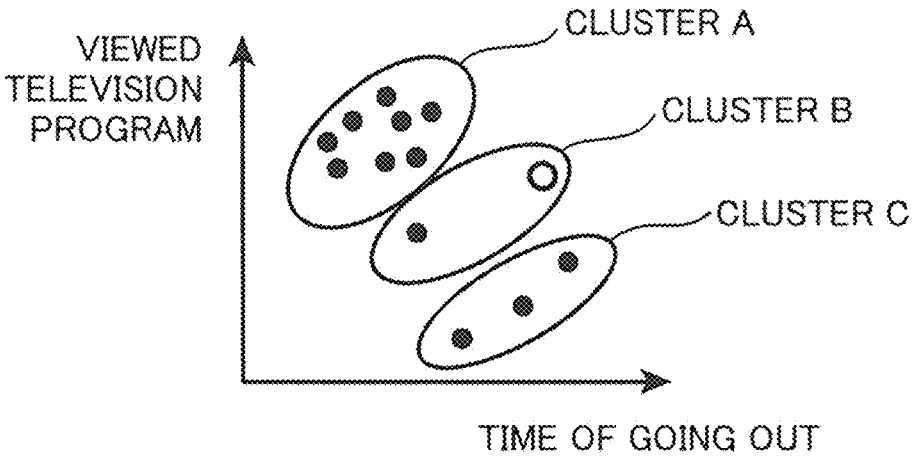
FIG. 13B is a diagram showing a cluster process when each piece of past data and current data shown in FIG. 7A or 7B is used as input data.

Next, a specific process will be described. FIGS. 13A and 13B are diagrams showing a cluster process when each piece of past data and current data shown in FIG. 7A or 7B is used as input data.

Moreover, for the sake of brevity, this example also adopts only two types of data including a time of going out and a viewed television program as input data. A clustering process is performed on such multi-dimensional input data (two dimensional in this example) by, for example, the k-means method.

In both FIG. 13A and FIG. 13B, a vertical axis represents a viewed television program and a horizontal axis represents a time of going out. FIG. 13A shows input data prior to being plotted and FIG. 13B shows a result of a cluster process of the input data shown in FIG. 13A. In the example shown in FIG. 13B, the input data is classified into three clusters A, B, and C. In addition, in FIGS. 13A and 13B, black dots indicate past data shown in FIGS. 7A and 7B while white dots indicate current data shown in FIGS. 7A and 7B. As shown in FIG. 13B, current data is clustered to cluster B.

Returning now to FIG. 8, the selecting unit 303 judges whether or not the cluster to which the current data belongs satisfies a prescribed cluster condition (S705).

FIG. 14 is a diagram showing an example of a cluster condition. In the example shown in FIG. 14, three conditions are presented as cluster conditions. Condition 1 is a condition for judging, for each cluster, a validity of the cluster based on whether or not the number of pieces of clustered input data is greater than a threshold. For example, the number of pieces of clustered input data of the cluster A is 8 and is greater than the threshold 5. Therefore, the cluster A satisfies the condition 1, and when only the condition 1 is adopted as a cluster condition, the cluster A is a valid cluster.

On the other hand, the number of pieces of input data of the cluster B to which the current data belongs is 2 and is equal to or smaller than the threshold. Therefore, the cluster B does not satisfy the condition 1 and is judged not to be a valid cluster.

As described above, when only the condition 1 is adopted as a cluster condition, if the number of pieces of input data clustered to the cluster to which the current data belongs is greater than 5 that is the threshold, a judgment of YES is made in S705 and the process is advanced to S706. In other words, if the number of pieces of input data clustered to the cluster B to which the current data belongs is greater than 5, the process is advanced to S706.

Subsequently, in S705, a setting file is created in which a setting state corresponding to each cluster is written. In this case, the setting file is generated by writing a most numerous setting state among setting states corresponding to input data of each cluster into the setting file.

In S706, the selecting unit 303 reads a setting state corresponding to the cluster to which the current data belongs from the setting file.

FIG. 9 is a diagram showing an example of a setting file. The setting file shown in FIG. 9 represents a setting file of a user whose user ID is "978". In addition, in the setting file shown in FIG. 9, one row represents one cluster. Furthermore, a clustering result when a cluster process is performed with data which associates a time of going out, a day of the week, the number of people at home, and a viewed television program with each other as input data is written into the setting file shown in FIG. 9. Therefore, "time blocks", a "day of the week", the "number of people at home", and a "viewed television program" are written into the setting file. In this case, as the "time block", a convenient time slot including a latest time and an earliest time among the "time of going out" indicated by the clustered input data. In other words, the setting file shown in FIG. 9 represents clustering that uses a time of going out, a day of the week, the number of people at home, and a viewed television program as input data.

In addition, in FIG. 9, a "setting state" represents a most numerous setting state among setting states corresponding to input data belonging to each cluster. For example, among the setting states corresponding to input data belonging to a cluster represented by a row of a time slot "6:00 to 12:00", "hot water lock" is a most numerous setting state of the "electric thermos pot", "off" is a most numerous setting state of the "IHC", and "off" is a most numerous setting state of the "washing machine". Therefore, the setting states of "hot water lock", "off", and "off" are respectively written for the "electric thermos pot", the "IHC", and the "washing machine" in the row of the time slot "6:00 to 12:00".

Let us assume that it is now "12:00" on "Monday" and current setting states of the "electric thermos pot", the "IHC", and the "washing machine" are "hot water lock", "off", and "child lock". In this case, since the usual setting state written in the setting file differs from a current setting state, a judgment of FALSE is made in S205 in FIG. 3 and a first notification is performed.

On the other hand, in this example, assuming that the current setting states of the "electric thermos pot", the "IHC", and the "washing machine" are "hot water lock", "off", and "off", since the current setting states are the same as the usual setting states shown in FIG. 9, a judgment of TRUE is made in S205 in FIG. 3 and a second notification is performed.

In addition, a setting state recorded in a "Default" row in FIG. 9 represents a default value to be read in S710 to be described later.

Moreover, while an example using only the condition 1 as a cluster condition in S705 has been described above, a plurality of conditions including the conditions 2 and 3 shown in FIG. 14 may be used instead. For example, as the cluster condition, the condition 2 may be further added to the condition 1.

The condition 2 is a condition under which a cluster is valid if the number of a most numerous setting state among setting states corresponding to the clustered input data is equal to or greater than a certain number. For example, with the cluster A, "microwave oven: child lock", "television set: off", and "air conditioner: off" are most numerous setting states and the number of pieces of data having these setting states is equal to or greater than a certain value. Therefore, it is determined that the cluster A satisfies the condition 2. In this case, as the certain value, a ratio to a total number in the cluster can be adopted. In addition, as the ratio, a majority (for example, 50%) may be adopted or a value greater than the majority such as 90%, 80%, 70%, and 60% of the total number in the cluster may be adopted. For example, when a majority is adopted as the certain value, if a ratio of "microwave oven: child lock" is 80%, a ratio of "television set: off" is 80%, and a ratio of "air conditioner: off" is 80% in the cluster A, since every ratio exceeds the majority, it is determined that the cluster A satisfies the condition 2.

In this case, while a ratio to a total number has been adopted as the certain value, a fixed value may be adopted instead. Alternatively, a number calculated using statistical analysis may be adopted as the certain value. Under the condition 2, only a cluster with uniformity in setting states is treated as a valid cluster.

Furthermore, the condition 3 may be added as a cluster condition in place of or in addition to the condition 2. The condition 3 is a condition under which, in an object cluster, if a center value of the cluster varies significantly as a result of adding the current data, the cluster is removed from valid clusters.

Figure 15A:
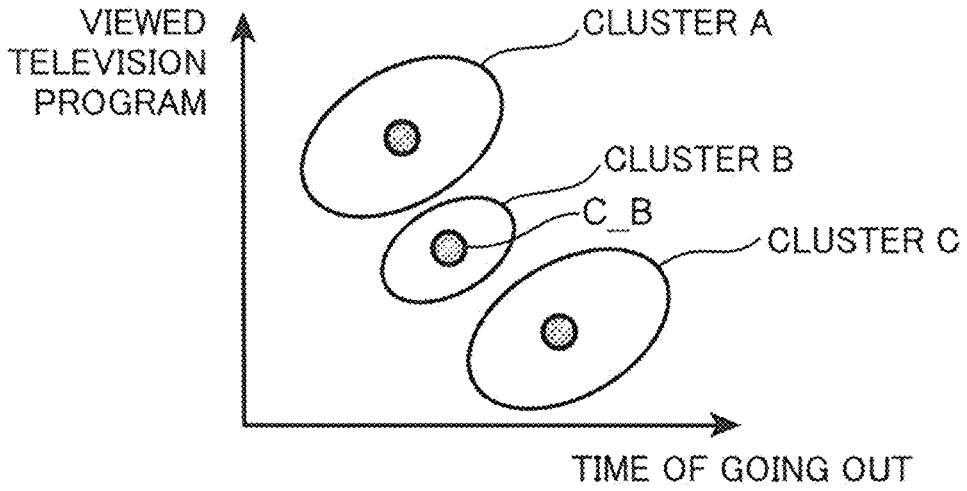
FIG. 15A is a diagram showing an example of a cluster condition.
Figure 15B:
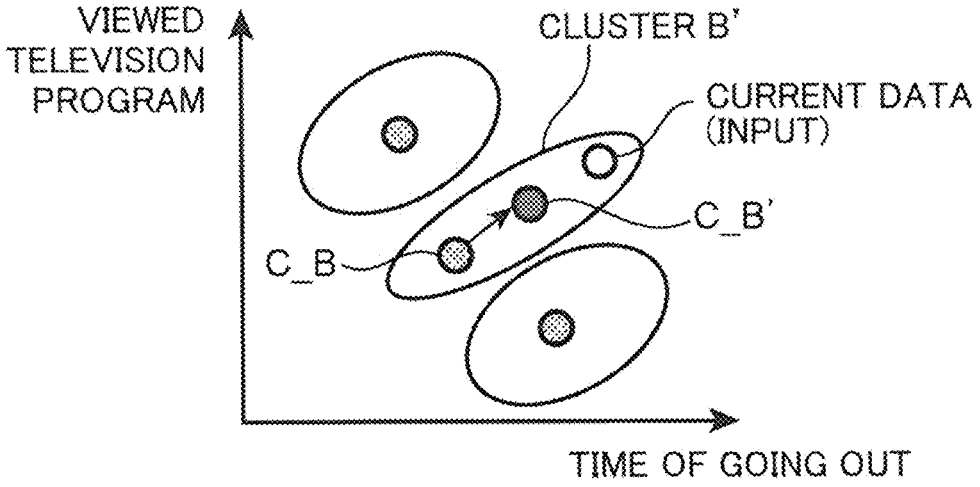
FIG. 15B is a diagram showing an example of a cluster condition.

FIGS. 15A and 15B are diagrams showing an example of a cluster condition. FIG. 15A is a diagram showing a cluster process when only past data is used as input data, and FIG. 15B is a diagram showing a variation in a center value when current data is added to a result of clustering of past data. Moreover, in FIGS. 15A and 15B, a vertical axis and a horizontal axis are the same as those in FIGS. 13A and 13B.

FIG. 15A shows a result of clustering when past data of a viewed television program and a time of going out is used as input data, whereby the input data is classified into three clusters A, B, and C. In doing so, the selecting unit 303 calculates a center value for each cluster. A center value of the cluster B is to be expressed as C_B. Next, the selecting unit 303 performs clustering by adding the current data to the result of clustering shown in FIG. 15A. Subsequently, the selecting unit 303 once again calculates a center value of a cluster to which the current data belongs. In this case, as the center value, for example, a center of gravity of each cluster is adopted.

In the example shown in FIG. 15B, current data is classified into the cluster B. The cluster B when current data is added thereto will be expressed as a cluster B'. Subsequently, the selecting unit 303 calculates a center value C_B' of the cluster B'. Next, the selecting unit 303 compares the center value C_B' with the center value C_B. When a distance (an amount of movement) between the center value C_B' and the center value C_B is greater than a certain value, the cluster B' is judged to be an invalid cluster. On the other hand, when the distance between the center value C_B' and the center value C_B is equal to or smaller than a certain value, the cluster B' is judged to be a valid cluster.

When a center value varies significantly when new data is added, it is highly likely that learning of the cluster is insufficient and a usual setting state has not been accurately corrected as a setting state corresponding to the cluster. Therefore, by adding the condition 3, a setting file is created in which data that more accurately represents a usual setting state is written.

Moreover, combinations of the three conditions described above may be varied. For example, the condition 1 and the condition 3 may be combined or only the condition 2 may be used. In other words, at least one condition among the conditions 1 to 3 may be used as the cluster condition. In addition, a condition other than those described above may be used as the cluster condition. In this case, any condition may be adopted as long as the condition treats a cluster that has not sufficiently learned activities of the user as an invalid cluster. Furthermore, while the k-means method has been shown as an analysis method of clustering, other clustering methods may be adopted.

While a cluster process performed within individual data of the user has been described above, when classification to a cluster satisfying a certain condition cannot be performed, a cluster process using data of all other users may be performed to extract a usual setting state. In other words, when a judgment of NO is made in S705, the selecting unit 303 executes processes of S707 and thereafter and performs a cluster process, using data of a plurality of other users managed by the server 200.

In S707, the selecting unit 303 executes a cluster process using the outside-of-house information 801 and the in-house information 802 of each user and the stored information 803 of all users shown in FIG. 10. Specifically, a clustering process is performed on in-house history of all users among the in-house history shown in FIGS. 7A and 7B.

In S705, while a cluster process is performed by using data of individual users to which the input data corresponds as input data, in S707, a cluster process is performed by using data of the other data in addition to the data of a corresponding user as input data. Otherwise, S707 is the same as S704.

In this case, as input data, data of a certain period of time in the past of all users managed by the server 200 may be adopted of data of a certain period of time in the past of users satisfying a prescribed condition among all users may be adopted. Moreover, as the prescribed condition, a condition under which a same family structure as a corresponding user is shared or a condition under which a same gender and age group as the corresponding user is shared can be adopted.

Taking FIGS. 13A and 13B as an example, in S704, while a cluster process is performed using a viewed television program and a time of going out of one user (user A) as input data, in S707, a cluster process is performed using a viewed television program and a time of going out of other users managed by the server 200 in addition to the user A.

In S708, the selecting unit 303 judges whether or not a cluster to which the current data belongs is a cluster satisfying a prescribed cluster condition in a similar manner to S705. Subsequently, in S708, when a valid judgment is made (YES in S708), the process is advanced to S709, and when an invalid judgment is made (NO in S708), the process is advanced to S710. Moreover, in S708, a setting file is generated by writing a most numerous setting state among setting states corresponding to input data of each cluster into the setting file in a similar manner to S705. In this case, a setting file is generated in which a user ID is omitted from the setting file shown in FIG. 9.

In S709, the selecting unit 303 reads a setting state corresponding to the cluster to which the current data belongs from the setting file generated in S708 in a similar manner to S706. In this case, setting states of many users in a similar situation to a current situation inside the house of the user A is to be read. When the current setting state of the user A differs from the setting state read in S709, a judgment of FALSE is made in S205 shown in FIG. 3 and a first notification is executed. On the other hand, when the current setting state of the user A is the same as the setting state read in S709, a judgment of TRUE is made in S205 shown in FIG. 3 and a second notification is executed.

Moreover, since details of the processes of S708 and S709 are the same as those of S705 and S706, a description thereof will be omitted. However, as the threshold used to determine the validity of a cluster or the like, a value different from that in S705 is used as appropriate. For example, in S708, the number of pieces of data is significantly large compared to S705 since data of not only a specific user but also other users is used. Therefore, as the threshold of the condition 1, while a value (for example, 5) that assumes one user is adopted in S705, a value in accordance with the number of pieces of data that are process objects is adopted in S708. In addition, since the number of pieces of data that are considered process objects in S707 is significantly large compared to S704, a cluster process based on a different algorithm from the cluster process used in S704 may be adopted.

In S710, the selecting unit 303 reads a default value of a setting state. In this case, as the default value, for example, a value determined upon initialization by the user may be adopted or a value determined in advance by a manufacturer of each device 400 upon shipment thereof may be adopted.

For example, in the case of a heat-generating device 400, "off" is adopted as the default value, and in the case of a rotating device 400, "child lock" is adopted as the default value.

As described above, when a position of a user from inside of the house to the outside of the house or from outside of the house to the inside of the house, a setting state of each device 400 and a usual setting state of each device 400 under a same situation that is learned from data of a corresponding user or data of other users is compared. In addition, a second notification to the user is executed when the result of the comparison is true, a first notification to the user is executed when the result of the comparison is false, and the information terminal 300 enters a standby state of an operation input by the user. Therefore, since a notification that compels the user to perform an input is only presented if required to the user upon a user going out or upon the user coming home, an operation burden on the user can be reduced.

(First Modification)

Figure 16:
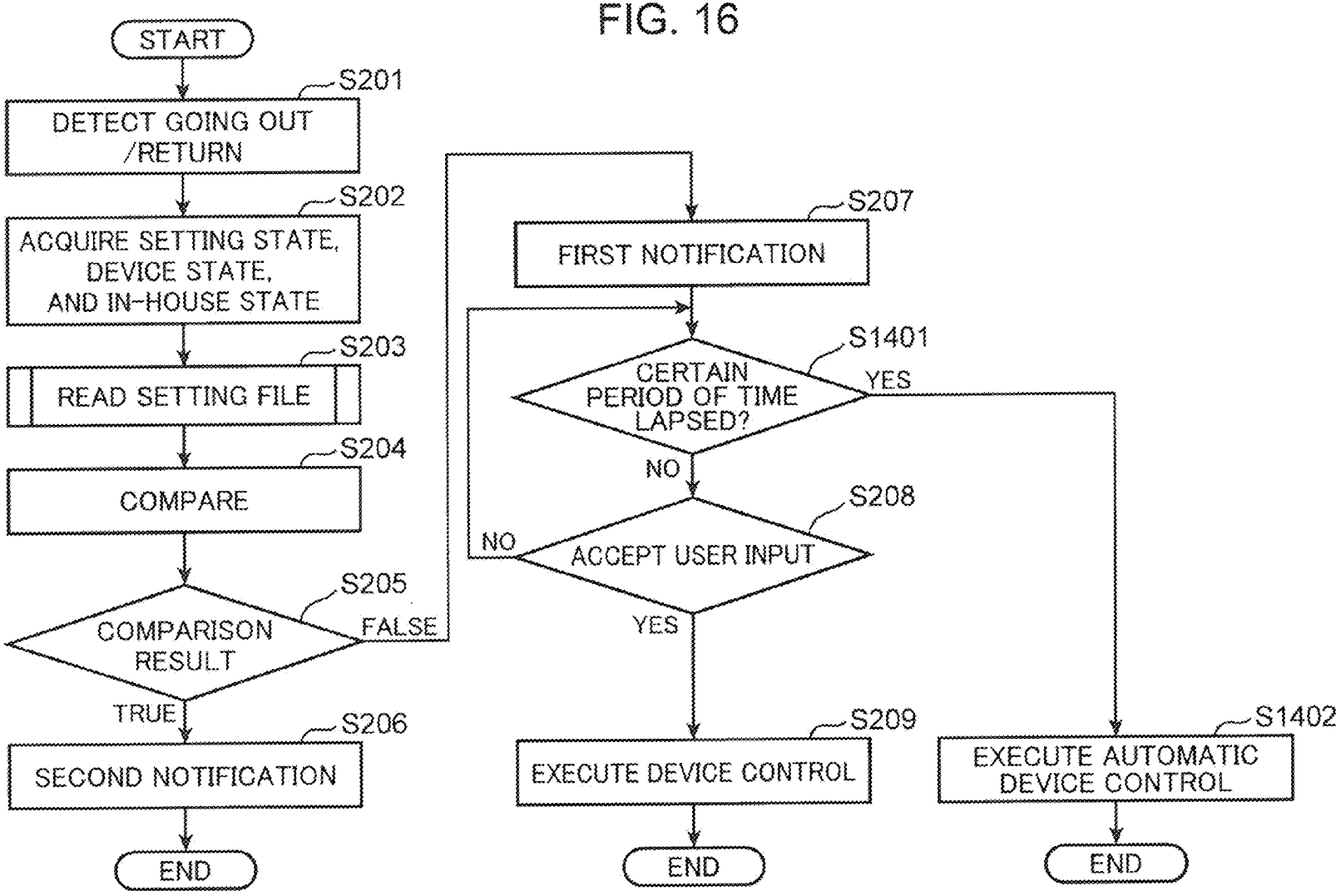
FIG. 16 is a diagram showing a process flow of a first modification of a present embodiment.

FIG. 16 is a diagram showing a process flow of a first modification according to the present embodiment. The process flow shown in FIG. 16 differs from the process flow shown in FIG. 3 in that processes of S1401 and S1402 are further added. Since the processes shown in FIG. 16 are otherwise the same as those shown in FIG. 3, a description thereof will be omitted.

In S1401, the state transition unit 305 judges whether or not a certain period of time has lapsed from the execution of the first notification. When an operation input by the user is performed within the certain period of time (NO in S1401 and YES in S208), in a similar manner to FIG. 3, the state transition unit 305 executes device control in accordance with the operation input by the user (S206).

On the other hand, when an operation input by the user is performed within the certain period of time (YES in S1401), the state transition unit 305 executes automatic device control in which each device 400 is operated in a setting state indicated in the setting file read in S203 (S1402). In this case, from the perspective of reducing the number of operation inputs, in the case of the first notification, the user may be asked to input a response only in rare cases when the setting state of the device 400 is intentionally set so as to differ from usual. In consideration thereof, when the first notification is executed but an operation input in response to the first notification is not performed by the user within the certain period of time, the state transition unit 305 forcibly restores the setting state of the device 400 to the usual setting state.

Figure 17:
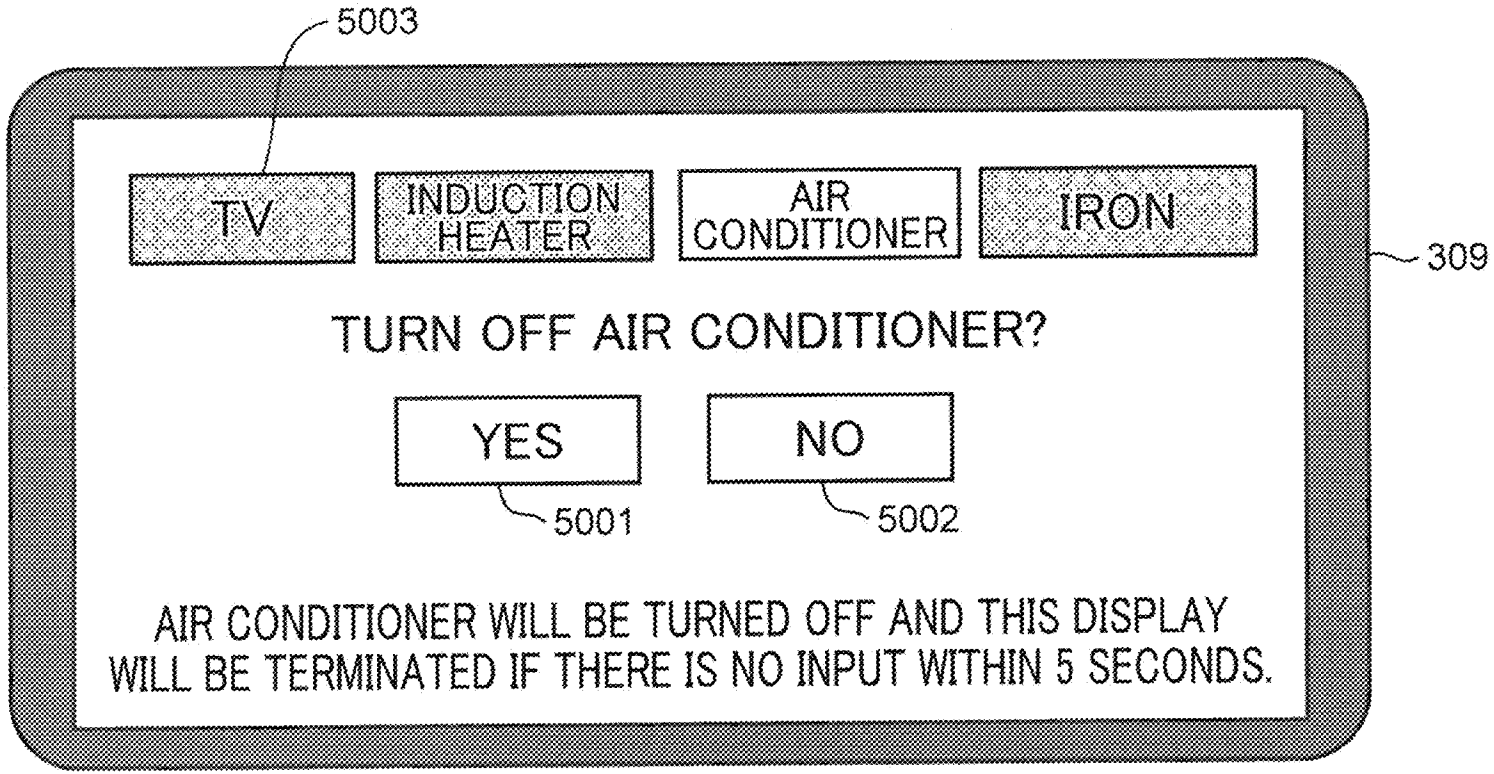
FIG. 17 is a diagram showing an example of a first notification according to the first modification of the present embodiment.

FIG. 17 is a diagram showing an example of a first notification according to the first modification of the present embodiment. In the example shown in FIG. 17, a TV, an induction cooker, an air conditioner, and an iron are adopted as the device 400. In addition, since the setting state of the air conditioner is an "on" state which differs from the usual setting state at the time when the user goes out, in the example shown in FIG. 17, the icon 5003 of the air conditioner is displayed in white and a text reading "Turn off the air conditioner?" indicating an inquiry is displayed.

Furthermore, a "yes" icon 5001 for turning off the air conditioner as usual and a "no" icon 5002 for maintaining the setting state of the air conditioner to the on state are displayed below the text.

When the air conditioner has been intentionally turned at the time of this particular going out, the user selects the "no" icon 5002. On the other hand, when the user has gone out forgetting to turn off the air conditioner, the user selects the "yes" icon 5001. At this point, in the first modification, the air conditioner is automatically turned off once a certain period of time (5 seconds in FIG. 17) has lapsed even if the user does not input any operations in response to the first notification. Therefore, in the example shown in FIG. 17, a text reading "If there is no input in 5 seconds, the air conditioner will be turned off and this display will be terminated" is displayed. Accordingly, when the user has gone out forgetting to turn off the air conditioner, the setting state of the air conditioner can be restored to the usual setting state even when a response to the first notification is not particularly input. As a result, the number of operations by the user is reduced by one and operability is improved.

(Second Modification)

Figure 18A:
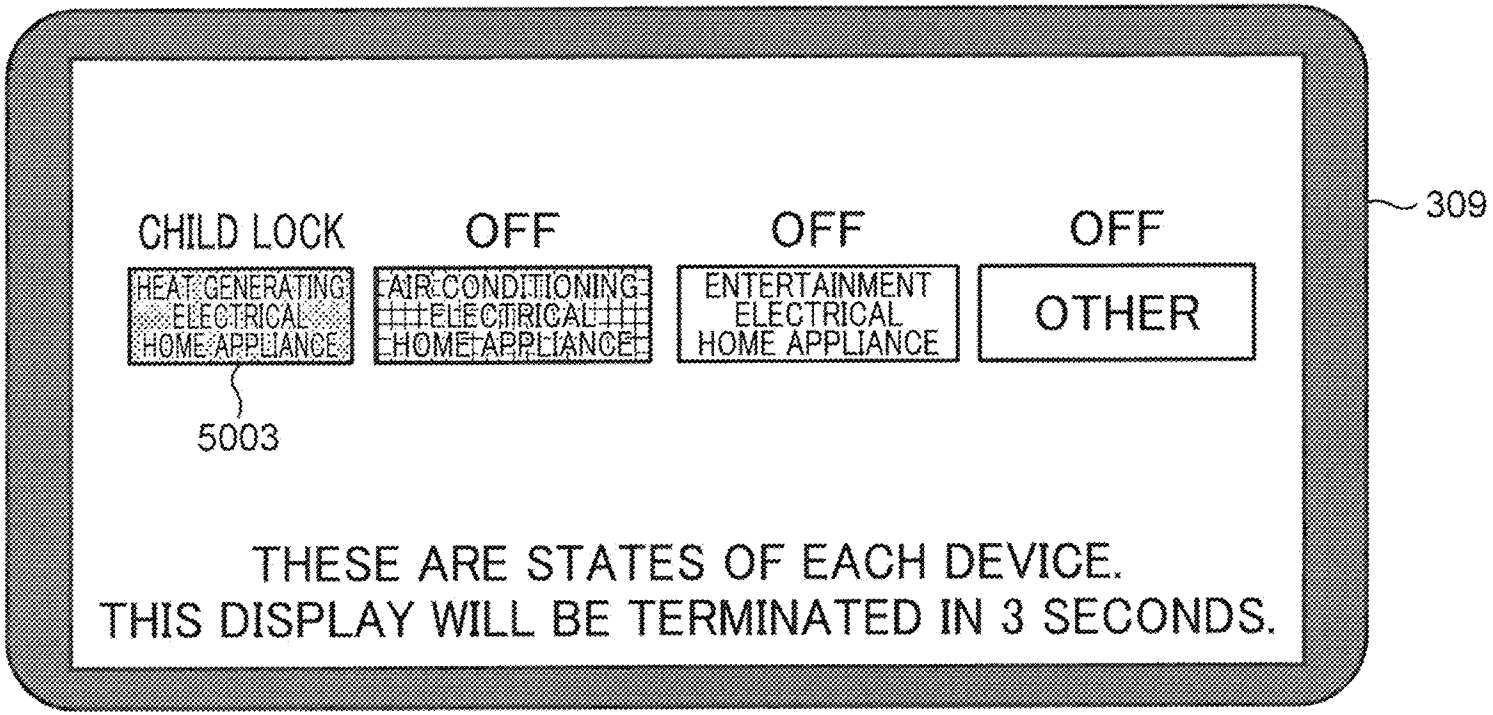
FIG. 18A is a diagram showing a first example of a second notification according to a second modification of the present embodiment.
Figure 18B:
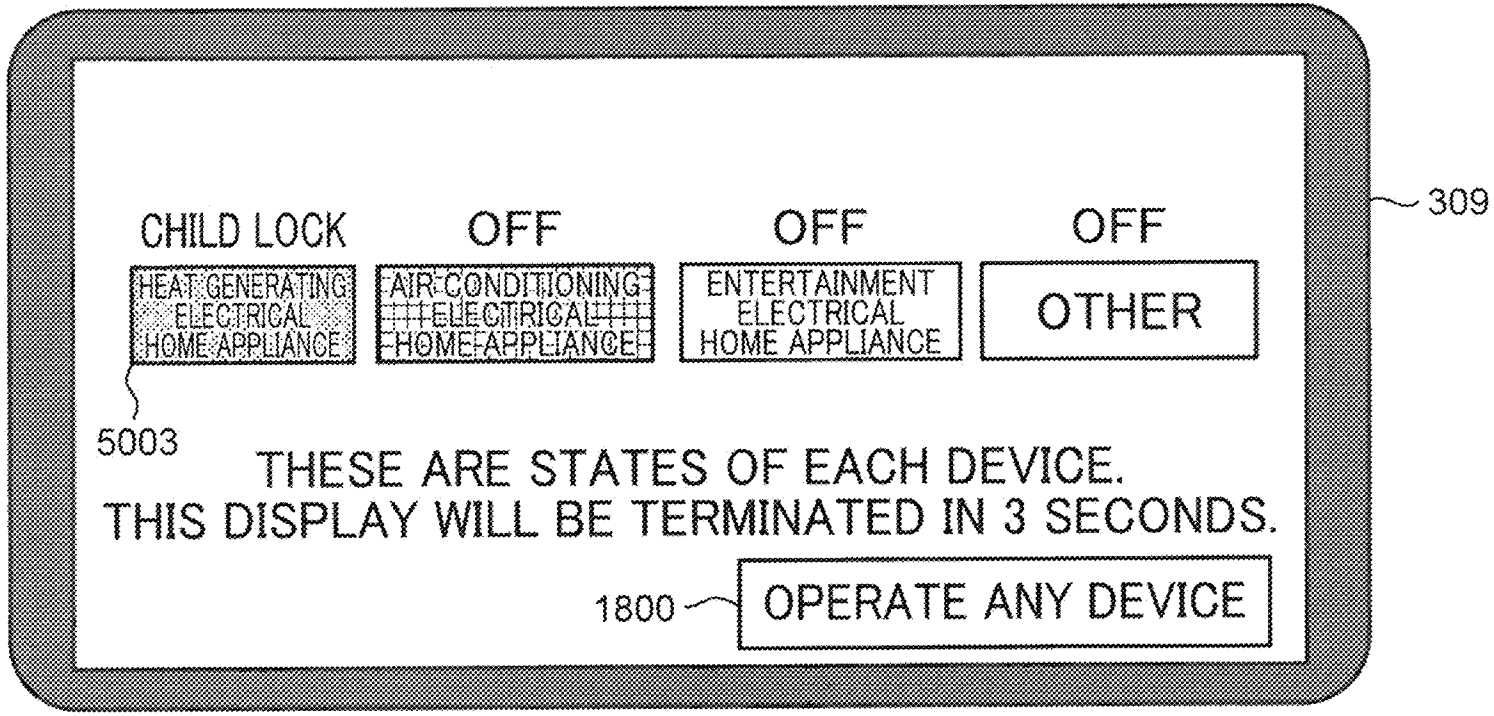
FIG. 18B is a diagram showing a second example of a second notification according to the second modification of the present embodiment.

Next, a second modification representing modifications of the first and second notifications will be described. FIG. 18A is a diagram showing a first example of a second notification according to the second modification, and FIG. 18B is a diagram showing a second example of the second notification according to the second modification.

In the example of the second notification shown in FIG. 18A, in addition to a message describing that a setting state of the device 400 is the same as usual, an icon 5003 indicating a setting state of each device 400 is displayed. Simply confirming a message describing that a setting state is the same as usual does not enable the user to confirm what kind of setting state each device 400 is in and may cause anxiety. In consideration thereof, in the example shown in FIG. 18A, the setting state of each device 400 is specifically shown using the icon 5003 in order to avoid such problems. Accordingly, the user can feel further reassured.

When there are a large number of devices 400, it is difficult to display the setting states of all of the devices 400 at one on a small screen such as that of a smartphone. Therefore, in the example shown in FIG. 18A, an icon 5003 indicating the setting state of the device 400 for each category is adopted.

In the example shown in FIG. 18A, the devices 400 are classified into a "heat generating electrical home appliance", an "air conditioning electrical home appliance", an "entertainment electrical home appliance", and "other", and four icons 5003 corresponding to the four categories are displayed.

In this case, examples of a "heat generating electrical home appliance" include devices 400 such as an induction cooker, an electric kettle, and a toaster oven. Examples of an "air conditioning electrical home appliance" include devices 400 such as an air conditioner and an air purifier. Examples of an "entertainment electrical home appliance" include devices 400 such as a television set, a recorder, and a gaming device. "Other" represents devices 400 which do not belong to the three categories described above.

In addition, in the example shown in FIG. 18A, the setting state of each icon 5003 is displayed. For example, since the setting state of the "heat generating electrical home appliance" is "child lock", "child lock" is displayed. Moreover, in the example shown in FIG. 18A, when a plurality of devices 400 are included in each of the categories "heat generating electrical home appliance", "air conditioning electrical home appliance", and "entertainment electrical home appliance", it is assumed that usual setting states of the plurality of devices 400 are the same.

Furthermore, in the example shown in FIG. 18B, an invoking icon 1800 with the description "Operate a device" in order to display an operation dialog for operating the devices 400 is displayed in addition to the information shown in FIG. 18A. However, since the purpose of the second notification is to notify the user that the setting state of the device 400 is as usual, creating a standby state for an input increases an operation burden on the user. Therefore, the notification control unit 304 erases the second notification from the display 309 after a certain period of time (in this case, 3 seconds) elapses. Accordingly, in the example shown in FIG. 18B, a message reading "This display will be terminated in 3 seconds" is displayed. In addition, since it is sufficient for the second notification to notify the user that the setting state of the device 400 is the same as usual, even in the example shown in FIG. 18A, the second notification is erased from the display 309 after the lapse of a certain period of time (3 seconds). Accordingly, in the example shown in FIG. 18A, a message reading "This display will be terminated in 3 seconds" is similarly displayed.

Moreover, when the invoking icon 1800 is selected by the user in FIG. 18B, the notification control unit 304 displays a device list screen on which a list of names of the devices 400 is displayed on the display 309. Subsequently, when one device 400 is selected by the user from the device list screen, the notification control unit 304 displays an operation dialog of the selected device 400 on the display 309.

Figure 19A:
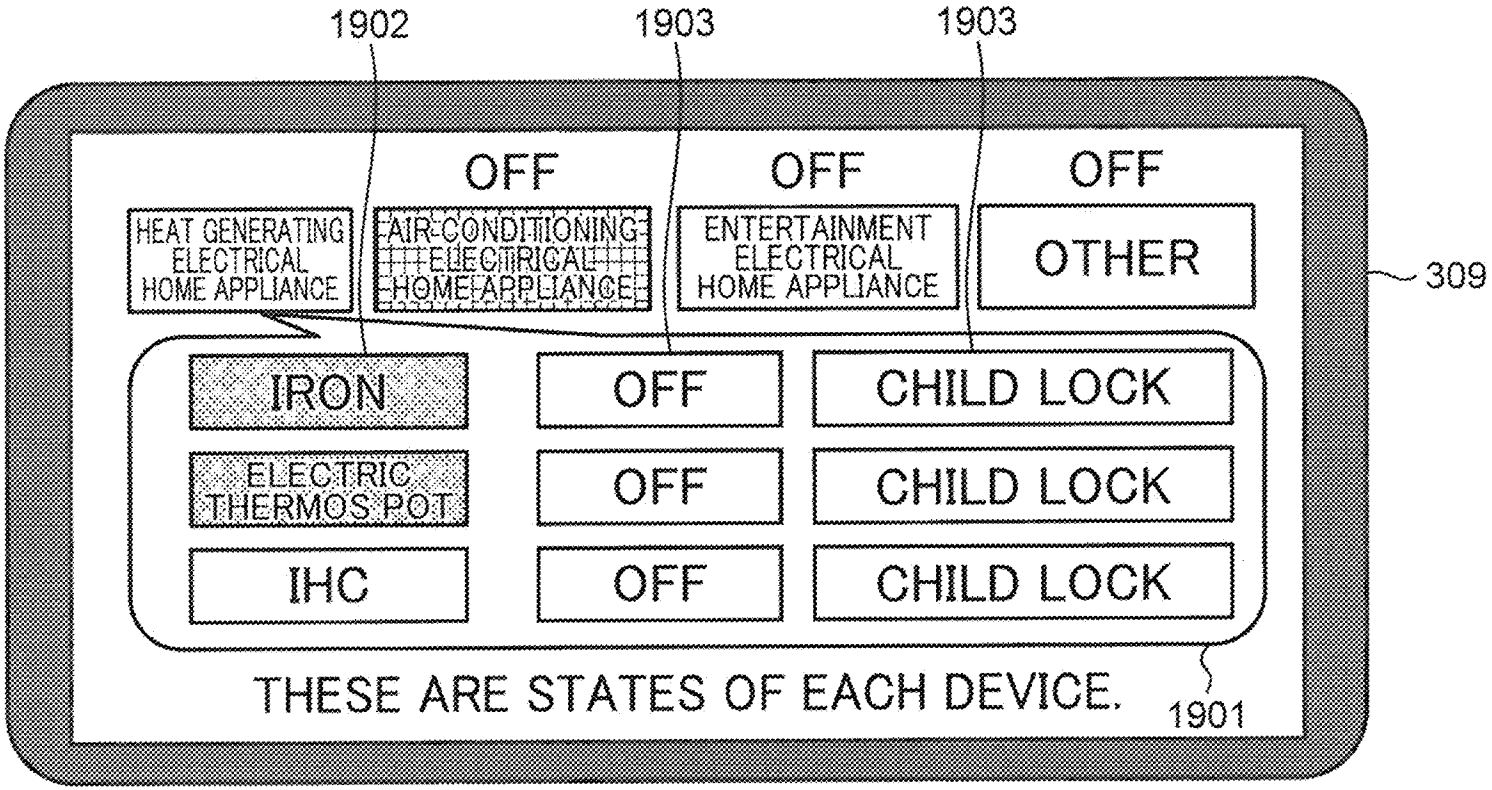
FIG. 19A is a diagram showing a first example of a first notification according to the second modification of the present embodiment.
Figure 19B:
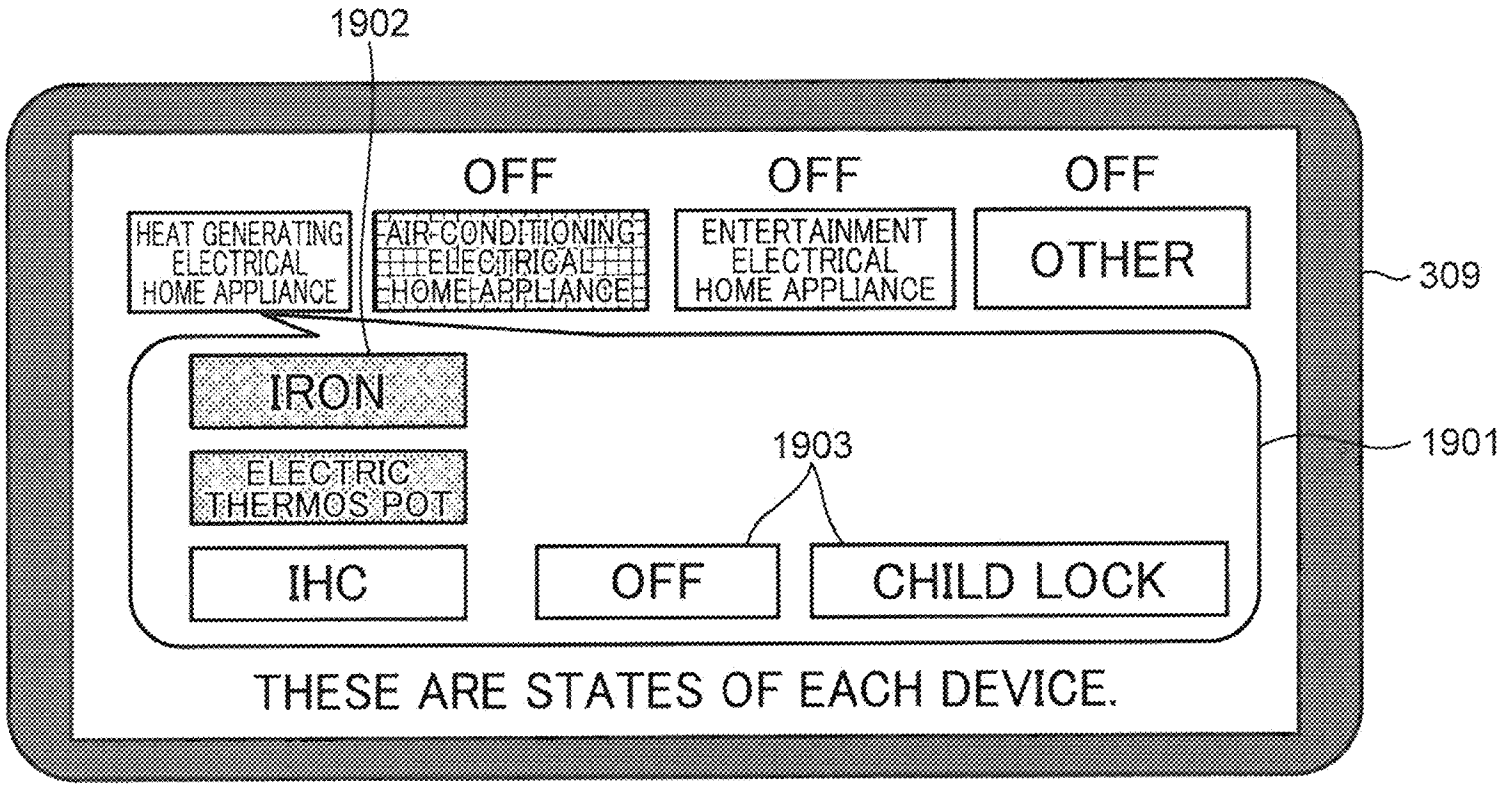
FIG. 19B is a diagram showing a second example of a first notification according to the second modification of the present embodiment.

FIG. 19A is a diagram showing a first example of a first notification according to the second modification, and FIG. 19B is a diagram showing a second example of the first notification according to the second modification. In the example shown in FIG. 19A, the "heat generating electrical home appliance" differs from a usual setting state. Therefore, the first notification shown in FIG. 19A indicates a setting state of each device 400 classified into "heat generating electrical home appliance" and, at the same time, displays an operation dialog 1901 including an operation button that enables each device 400 to be operated.

In the example shown in FIG. 19A, since the "heat generating electrical home appliance" includes an iron, an electric thermos pot, and an IHC, icons 1902 corresponding to the three devices 400 are displayed. In addition, in this example, while the iron and the electric thermos pot are turned off as usual, the IHC is turned on, which is not usual. Therefore, the icons 1902 of the iron and the electric thermos pot are displayed in a color (for example, gray) which indicates that the setting state is as usual and the icon 1902 of the IHC is displayed in a color (for example, white) which indicates that the setting state is not as usual.

Furthermore, in order to operate the iron, the electric thermos pot, and the IHC, two buttons 1903 per each device 400 are displayed in the operation dialog 1901 shown in FIG. 19A. In this case, two buttons 1903 for setting "off" and "child lock" are respectively displayed for the iron, the electric thermos pot, and the IHC.

Using the operation dialog 1901, the user realizing that he/she forgot to turn off the IHC can turn off the IHC by selecting the "off" button 1903 corresponding to the IHC.

The first notification shown in FIG. 19B differs from FIG. 19A in that the buttons 1903 are only displayed for devices 400 whose setting state is not as usual. In the example shown in FIG. 19B, only the setting state of the IHC among the devices 400 classified as heat generating electrical home appliances differs from the usual. Therefore, the icon 1902 of the IHC is displayed in white and, at the same time, only the two buttons 1903 for operating the IHC are displayed.

Figure 20:
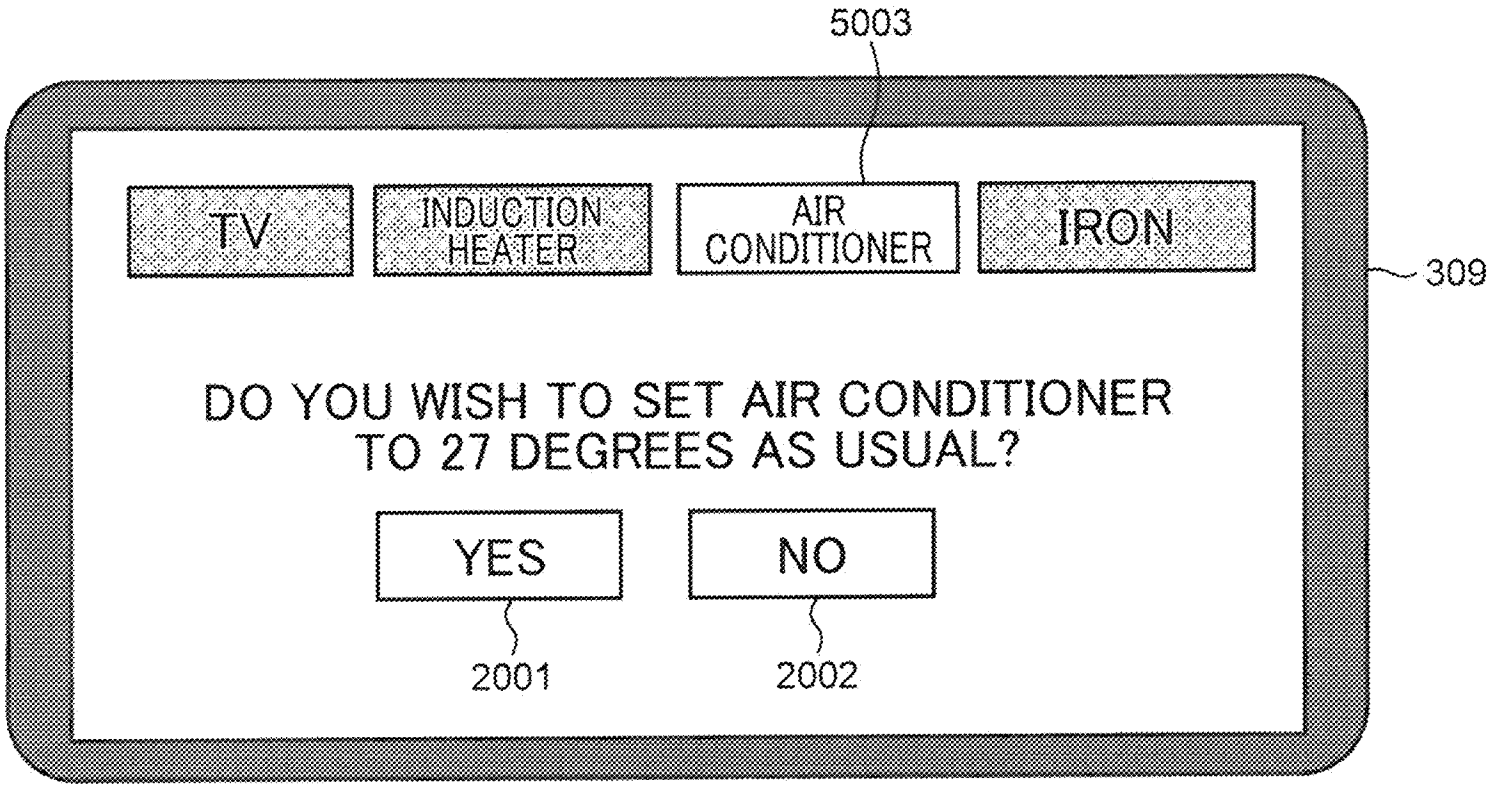
FIG. 20 is a diagram showing a third example of a first notification according to the second modification of the present embodiment.

FIG. 20 is a diagram showing a third example of the first notification according to the second modification. In the example shown in FIG. 20, a TV, an induction cooker, an air conditioner, and an iron are adopted as the device 400. In addition, in the example shown in FIG. 20, it is assumed that 27 degrees has been learned by the remote control system as a setting state of the air conditioner when the user comes home. Furthermore, in the example shown in FIG. 20, a current setting state when the user comes home differs from the learning result. Therefore, the icon 5003 of the air conditioner is displayed in a color (white in FIG. 20) indicating a difference from the usual setting state. Furthermore, in order to make the user aware of this fact, a text reading "Do you wish to set the icon to 27 degrees as usual?" is displayed in the example shown in FIG. 20. Let us assume that the user has selected the "yes" icon 2001. As a result, the remote control system recognizes that the learning result is right. On the other hand, let us assume that the user has selected the "no" icon 2002. As a result, the remote control system recognizes that the learning result is wrong. In addition, when the learning result is wrong, the remote control system may treat a cluster corresponding to the learning result as, for example, an invalid cluster and once again perform a cluster process.

(Third Modification)

Figure 21A:
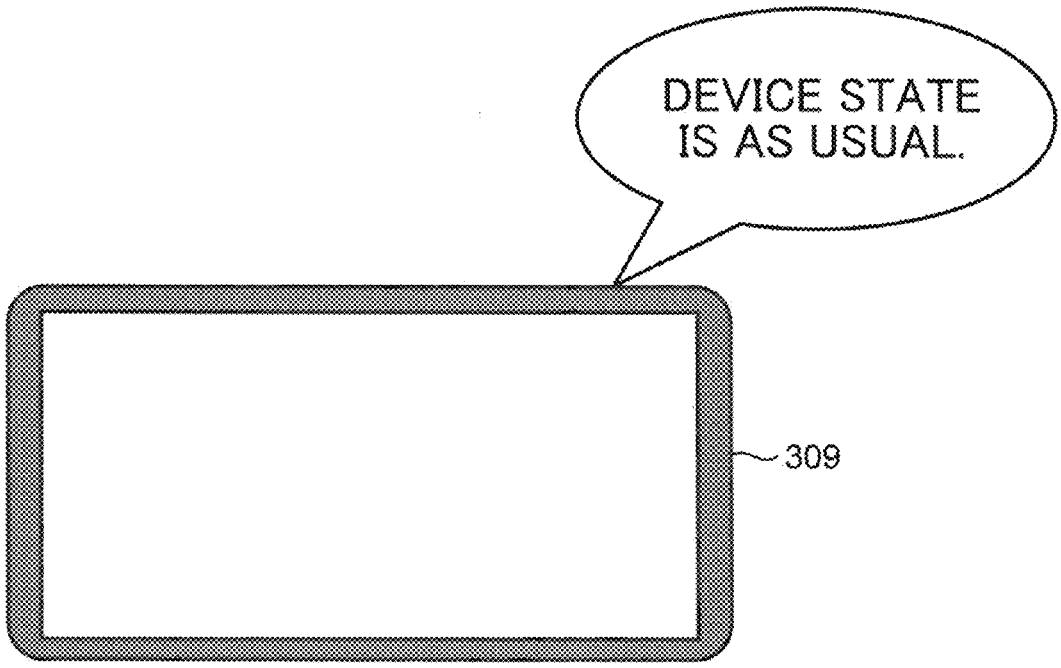
FIG. 21A is a diagram showing a second notification according to a third modification of the present embodiment.
Figure 21B:
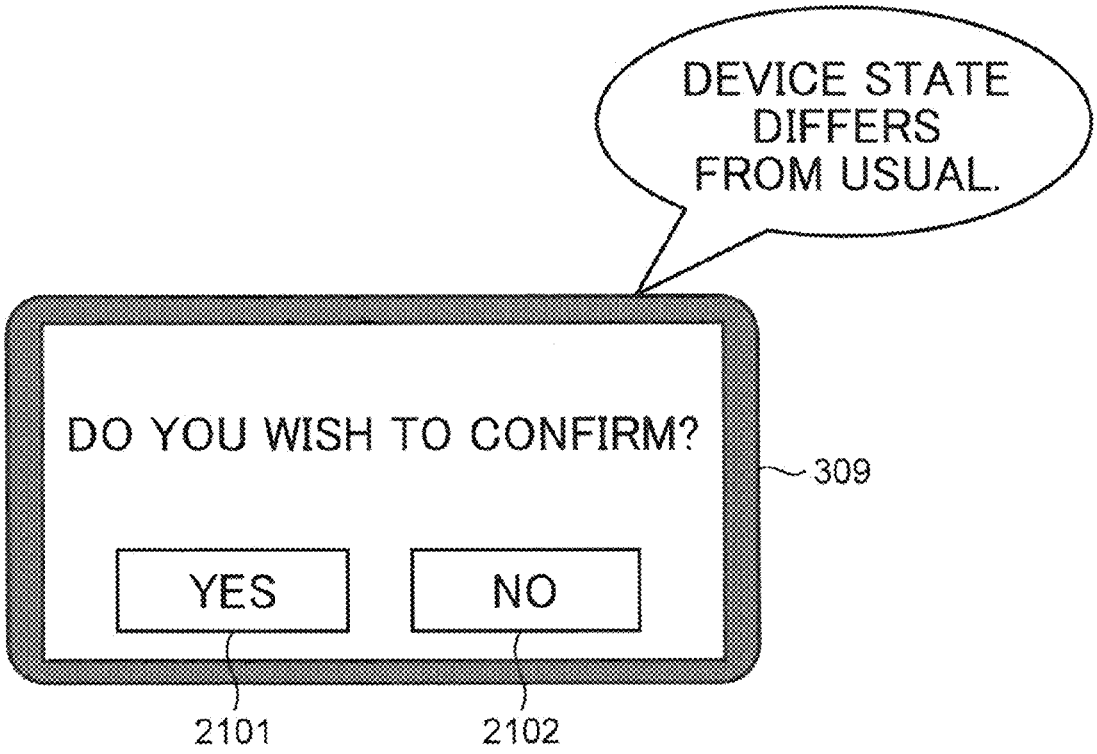
FIG. 21B is a diagram showing a first notification according to the third modification of the present embodiment.

In the present disclosure, the first notification and the second notification are visually performed using images. However, the present disclosure is not limited thereto and the first and second notifications may be performed using sound. FIG. 21A is a diagram showing a second notification according to a third modification and FIG. 21B is a diagram showing a first notification according to the third modification. In the case of FIG. 21A, the notification control unit 304 executes the second notification by outputting an utterance of "Device state is as usual" from the speaker 308.

On the other hand, in the case of FIG. 21B, the notification control unit 304 outputs an utterance of "Device state differs from usual: Wish to confirm?" from the speaker 308 and, at the same time, outputs a screen with a message reading "The device state differs from usual: Wish to confirm?" to the display 309. The screen includes a "yes" icon 2101 and a "no" icon 2102.

In the third modification, the user may input a response to the first notification by selecting either the "yes" icon 2101 or the "no" icon 2102 or may input a response to the first notification by uttering either "yes" or "no".

As described above, in the third modification, the first and second notifications are made to the user at least using sound. Therefore, the user can be made aware of the first notification and the second notification in a more reliable manner. Moreover, in the present disclosure, the user may be made aware of the first notification and the second notification through touch in addition to, or in place of, sight and sound. In this case, for example, the notification control unit 304 may execute the first and second notifications by causing a vibrator of the information terminal 300 to vibrate. In addition, in this case, the notification control unit 304 may change frequencies of the vibrator between the first and second notifications. Furthermore, the notification control unit 304 may perform the first and second notifications to a mobile phone and a smartphone as the information terminal 300 or may perform the first and second notifications to a device other than the information terminal 300 such as a television set and a car navigation system.

The techniques described in the aspects above may be realized by, for example, the following types of cloud services. However, the types that realize the techniques described in the aspects above are not limited to the following types.

(Service Type 1: Proprietary Data Center Type)

Figure 22:
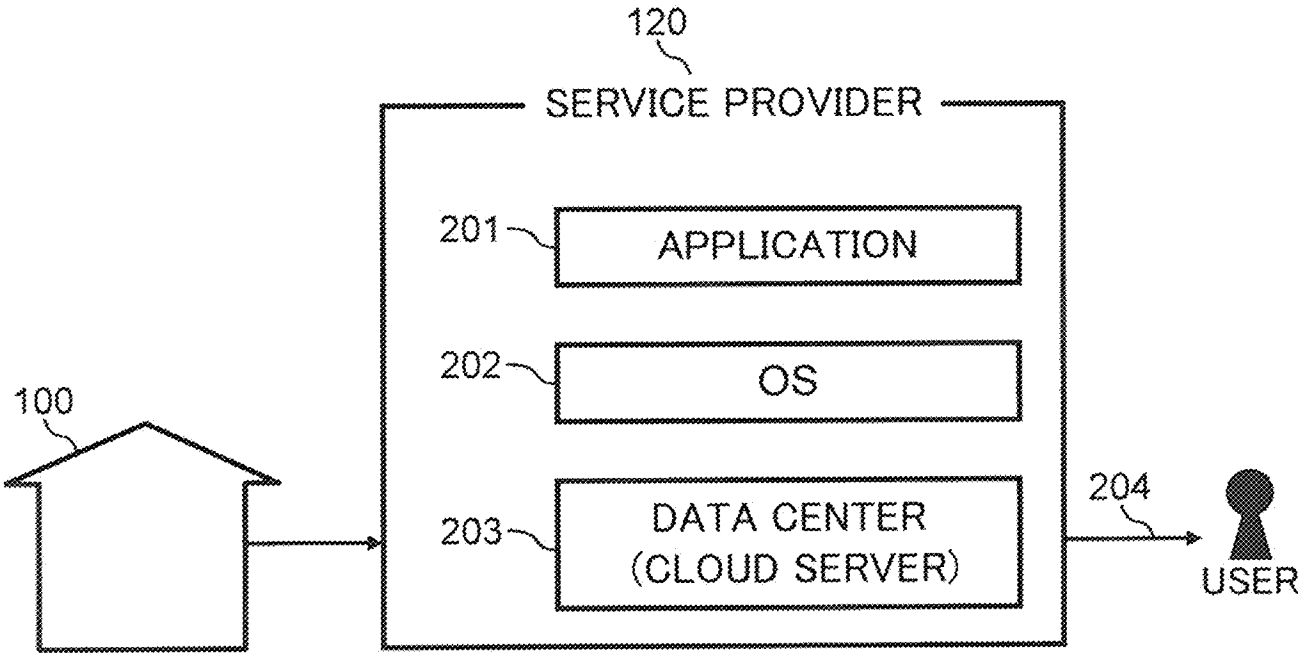
FIG. 22 is a diagram showing a service of type 1 (proprietary data center type).

FIG. 22 is a diagram showing a service of type 1 (proprietary data center type). The present type is a type in which the service provider 120 acquires information from the group 100 and provides service to a user. In the present type, the service provider 120 is equipped with functions of a data center operating company. In other words, the service provider 120 owns a data center 203 (a cloud server 111) that manages big data. Therefore, a data center operating company does not exist.

In the present type, the service provider 120 operates and manages the data center 203 (the cloud server 111). In addition, the service provider 120 manages an OS 202 and an application 201. The service provider 120 provides service to a user using the OS 202 and the application 201 managed by the service provider 120 (204).

(Service Type 2: Type Using IaaS)

Figure 23:
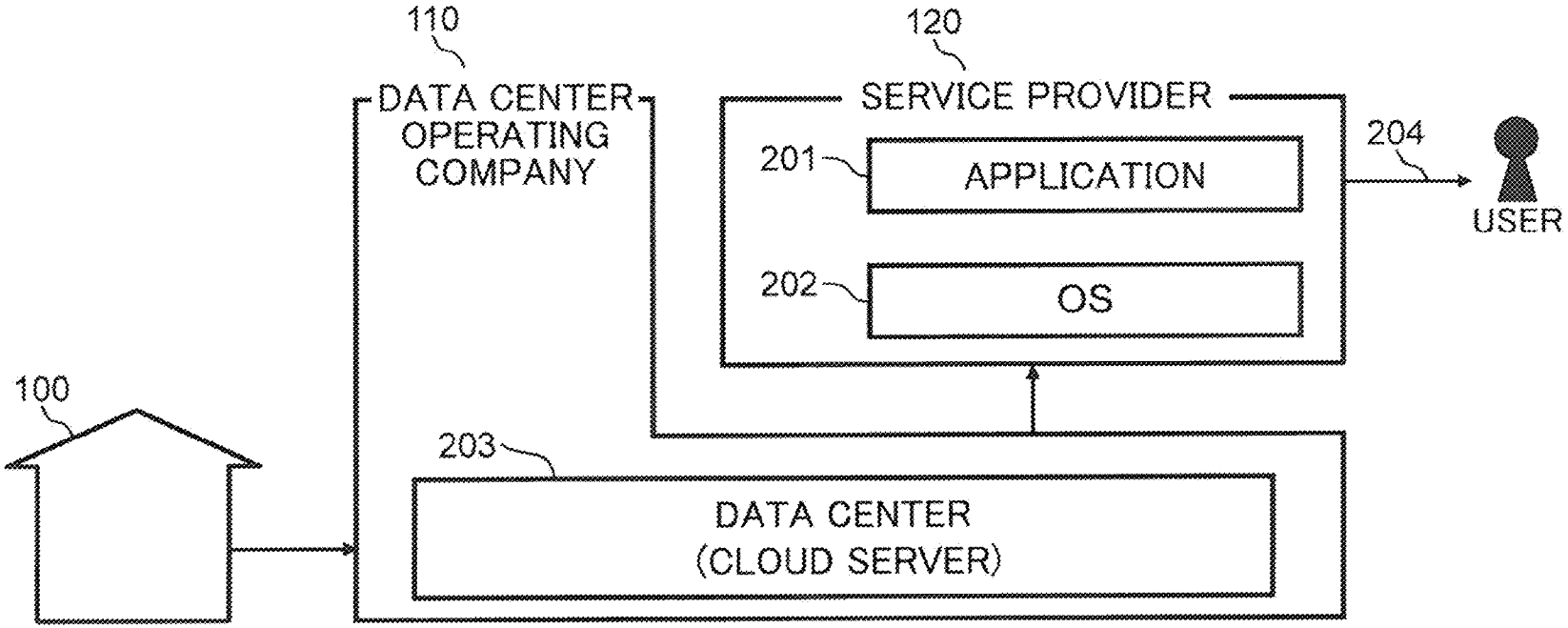
FIG. 23 is a diagram showing a service of type 2 (type using IaaS).

FIG. 23 is a diagram showing a service of type 2 (type using IaaS). In this case, IaaS stands for Infrastructure as a Service and refers to a cloud service provision model where an infrastructure for building and running a computer system itself is provided as an Internet-based service.

In the present type, the data center operating company 110 operates and manages 203 the data center 203 (the cloud server 111). In addition, the service provider 120 manages an OS 202 and an application 201. The service provider 120 provides service to a user using the OS 202 and the application 201 managed by the service provider 120 (204).

(Service Type 3: Type Using PaaS)

Figure 24:
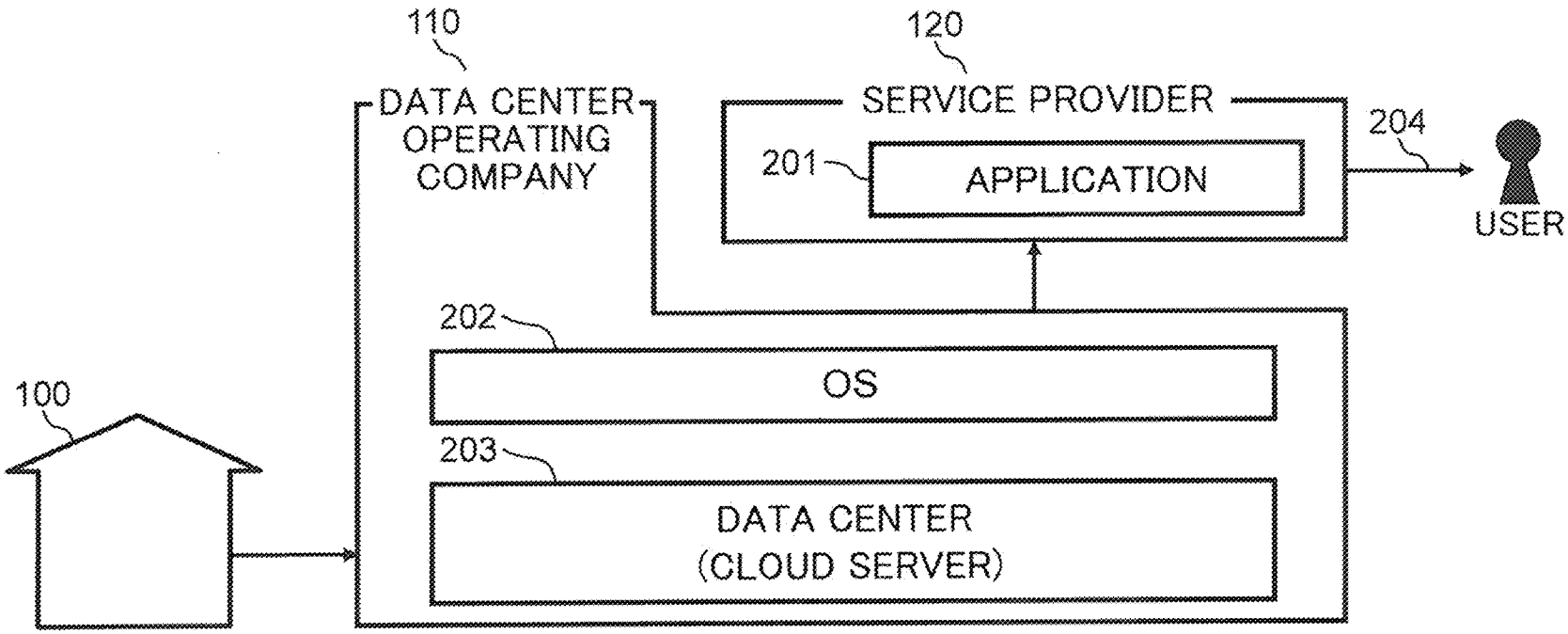
FIG. 24 is a diagram showing a service of type 3 (type using PaaS).

FIG. 24 is a diagram showing a service of type 3 (type using PaaS). In this case, PaaS stands for Platform as a Service and refers to a cloud service provision model where a platform that constitutes a foundation for building and running software is provided as an Internet-based service.

In the present type, the data center operating company 110 manages the OS 202 and operates and manages the data center 203 (cloud server 111). In addition, the service provider 120 manages the application 201. The service provider 120 provides service to a user using the OS 202 that is managed by the data center operating company and the application 201 that is managed by the service provider 120 (204).

(Service Type 4: Type Using SaaS)

Figure 25:
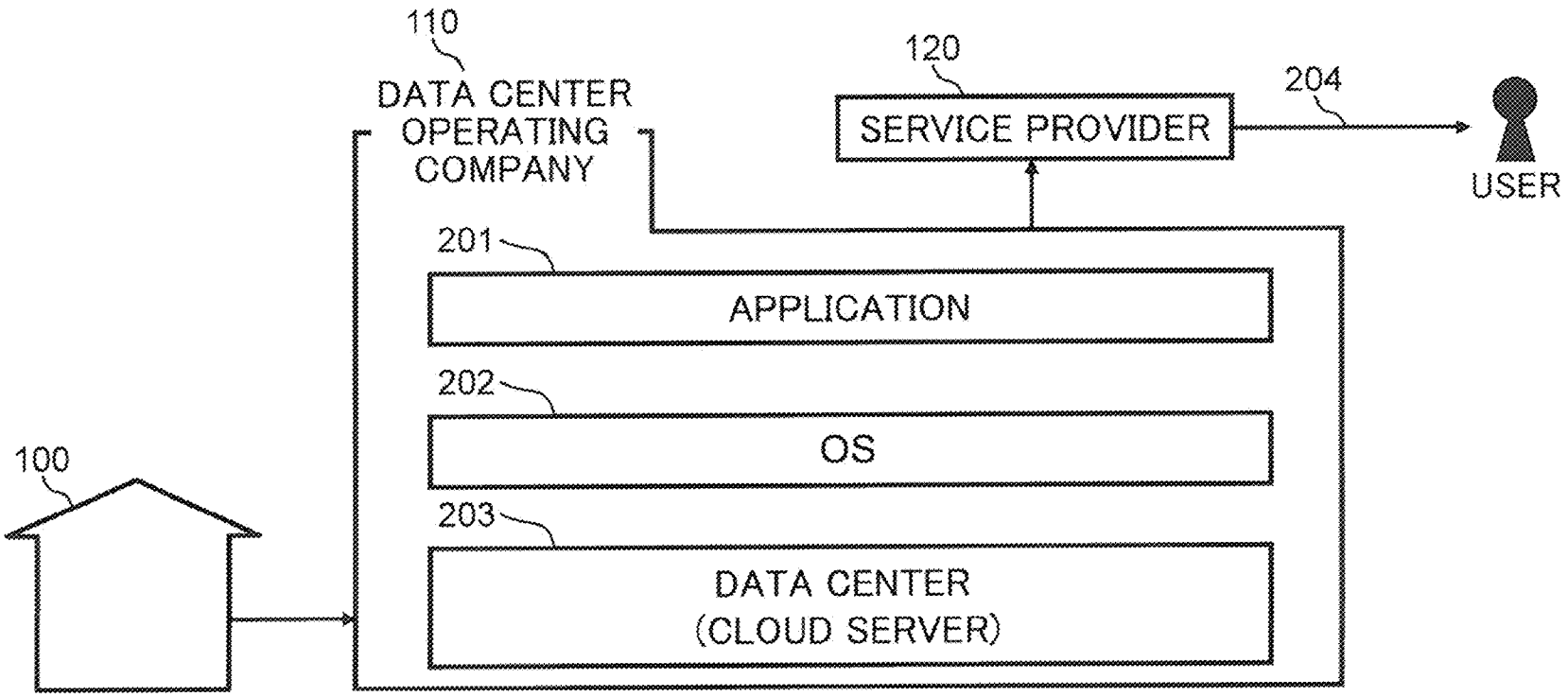
FIG. 25 is a diagram showing a service of type 4 (type using SaaS).

FIG. 25 is a diagram showing a service of type 4 (type using SaaS). In this case, SaaS stands for Software as a Service. This is a cloud service provision model equipped with, for example, a function that enables a company or an individual (a user) that does not own a data center (cloud server) to use an application provided by a platform provider that owns a data center (cloud server) via a network such as the Internet.

In the present type, the data center operating company 110 manages the application 201, manages the OS 202, and operates and manages the data center 203 (cloud server 111). In addition, the service provider 120 provides service to a user using the OS 202 and the application 201 managed by the data center operating company 110 (204).

As described above, it is assumed that the service provider 120 provides service in all types. In addition, for example, the OS 202, the application 201, a database for big data, and the like may be developed in-house or may be outsourced by the service provider 120 or the data center operating company 110.

INDUSTRIAL APPLICABILITY

The present disclosure is useful in a networked electrical home appliance system for remotely controlling the inside of a house.

The invention claimed is:

1. An information notification method in a remote control system that remotely controls a device installed inside a house of a user in use of an information terminal, the method comprising:

sensing a movement of the user from inside of the house to outside of the house or a movement of the user from outside of the house to inside of the house;

acquiring, when the movement is sensed, an in-house state indicating a state inside the house, a device state indicating a state of a prescribed first device installed inside the house, and a setting state of a second device which is installed inside the house and which is a remote control object;

selecting a usual setting state corresponding to the acquired in-house state and device state in use of the acquired in-house state and device state from a plurality of setting states classified in advance according to the in-house state and the device state, performing, when the selected usual setting state and the acquired setting state differ from each other, a first notification which notifies the user of the difference; and performing a transition of a state of the information terminal to a state of acceptance of an input for remotely controlling the second device.

2. The information notification method according to claim 1, wherein when the selected usual setting state and the acquired setting state match each other, a second notification which notifies the user of the match is performed.

3. The information notification method according to claim 1, wherein the in-house state includes the number of people at home.

4. The information notification method according to claim 1, wherein the remote control system includes a database that stores in association with one another the in-house state, the device state, and the setting state collected from inside one or more houses, and the classified setting state is a first setting state that is obtained by classifying the setting states collected from inside a first house in which one user who is to receive a service resides according to the in-house state and the device state or a second setting state obtained by classifying the setting state collected from inside the first house and from inside one or more second houses that differ from the first house according to the in-house state and the device state.

5. The information notification method according to claim 4, wherein the usual setting state is first selected from among the first setting states, and when the usual setting state cannot be selected from among the first setting states, the usual setting state is selected from among the second setting states.

6. The information notification method according to claim 2, wherein the first notification and the second notification are performed using at least one of an image and sound.

7. The information notification method according to claim 2, wherein the second notification is performed using an image, and once a certain period of time lapses after displaying the image, the image is erased to finish the second notification.

8. The information notification method according to claim 1, wherein the remote control system includes a database that stores in association with one another the in-house state, the device state, and the setting state collected from inside the house, and the in-house state and the device state stored in the database are clustered and the most numerous setting state among setting states corresponding to a cluster to which the acquired in-house state and device state belong is selected as the usual setting state.

9. The information notification method according to claim 8, wherein from among a first condition under which the number of pieces of clustered data in an object cluster to which the acquired in-house state and device state belong is greater than a first threshold, a second condition under which a proportion of the most numerous setting state among setting states corresponding to the object cluster is greater than a second threshold, and a third condition under which an amount of movement of a center value of the object cluster when the acquired in-house state and device state are added is equal to or less than a third threshold, when at least one condition is satisfied, the most numerous setting state corresponding to the object cluster is selected as the usual setting state.

10. An information terminal in a remote control system that remotely controls a device installed inside a house of a user in use of an information terminal, the information terminal comprising:

a sensing unit which senses a movement of the user from inside of the house to outside of the house or a movement of the user from outside of the house to inside of the house;

an acquiring unit which acquires, when the movement is sensed, an in-house state indicating a state inside the house, a device state indicating a state of a prescribed first device installed inside the house, and a setting state of a second device which is installed inside the house and which is a remote control object;

a selecting unit which selects a usual setting state corresponding to the acquired in-house state and device state in use of the acquired in-house state and device state from a plurality of setting states classified in advance according to the in-house state and the device state;

a notifying unit which, when the selected usual setting state and the acquired setting state differ from each other, performs a first notification that notifies the user of the difference; and a transition unit which causes a transition of a state of the information terminal to a state of acceptance of an input for remotely controlling the second device.

11. A non-transitory computer-readable recording medium which stores a program for an information terminal in a remote control system that remotely controls a device installed inside a house of a user in use of an information terminal, the program causing a computer of the information terminal to:

sense a movement of the user from inside of the house to outside of the house or a movement of the user from outside of the house to inside of the house;

when the movement is sensed, acquire an in-house state indicating a state inside the house, a device state indicating a state of a prescribed first device installed inside the house, and a setting state of a second device which is installed inside the house and which is a remote control object;

select a usual setting state corresponding to the acquired in-house state and device state in use of the acquired in-house state and device state from a plurality of setting states classified in advance according to the in-house state and the device state;

when the selected usual setting state and the acquired setting state differ from each other, perform a first notification which notifies the user of the difference; and cause a transition of a state of the information terminal to a state of acceptance of an input for remotely controlling the second device.

* * * * *